US008743169B2

(12) United States Patent
Ozasa

(10) Patent No.: US 8,743,169 B2
(45) **Date of Patent: *Jun. 3, 2014**

(54) PULSE-MODULATION-SIGNAL GENERATING DEVICE, LIGHT-SOURCE DEVICE, AND OPTICAL SCANNING DEVICE

(75) Inventor: Dan Ozasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 88 days.

This patent is subject to a terminal disclaimer.

(21) Appl. No.: 13/470,440

(22) Filed: May 14, 2012

(65) Prior Publication Data

US 2012/0249717 A1 Oct. 4, 2012

Related U.S. Application Data

(63) Continuation of application No. 12/360,573, filed on Jan. 27, 2009, now Pat. No. 8,194,113.

(30) Foreign Application Priority Data

Feb. 22, 2008 (JP) ..... 2008-040766

(51) Int. Cl.
*B41J 2/435* (2006.01)

(52) U.S. Cl.
USPC ..... 347/249; 347/247; 315/287

(58) Field of Classification Search
USPC ..... 315/287; 347/132, 135, 143, 144, 234, 347/235, 239, 243, 247–250; 358/410, 475, 358/509
See application file for complete search history.

(56) References Cited

U.S. PATENT DOCUMENTS

| | | | | |
|---|---|---|---|---|
| 6,498,617 | B1 | 12/2002 | Ishida et al. | |
| 6,731,317 | B2 * | 5/2004 | Ema et al. | 347/135 |
| 6,927,789 | B2 * | 8/2005 | Ozasa et al. | 347/249 |
| 6,933,957 | B2 | 8/2005 | Omori et al. | |
| 7,193,480 | B2 | 3/2007 | Ishida et al. | |
| 7,212,224 | B2 * | 5/2007 | Nihei et al. | 347/235 |
| 7,463,278 | B2 * | 12/2008 | Ozasa et al. | 347/249 |
| 7,528,995 | B2 | 5/2009 | Kawai | |
| 7,656,422 | B2 * | 2/2010 | Ozasa et al. | 347/250 |
| 7,791,634 | B2 | 9/2010 | Masui et al. | |
| 7,826,110 | B2 | 11/2010 | Tanabe et al. | |
| 2005/0146596 | A1 | 7/2005 | Nihei et al. | |
| 2005/0243163 | A1 | 11/2005 | Ozasa et al. | |
| 2006/0285186 | A1 | 12/2006 | Ishida et al. | |
| 2007/0091163 | A1 | 4/2007 | Omori et al. | |
| 2007/0206234 | A1 | 9/2007 | Ozasa et al. | |
| 2008/0012933 | A1 | 1/2008 | Nihei et al. | |
| 2008/0123160 | A1 | 5/2008 | Omori et al. | |

FOREIGN PATENT DOCUMENTS

| | | |
|---|---|---|
| JP | 3372564 | 11/2002 |
| JP | 3515087 | 1/2004 |
| JP | 2007-237415 | 9/2007 |

* cited by examiner

*Primary Examiner* — Vibol Tan
(74) *Attorney, Agent, or Firm* — Dickstein Shapiro LLP

(57) ABSTRACT

A high-frequency clock generating circuit generates a plurality of high-frequency clock signals having different phases. A modulation-signal generating circuit generates a pulse modulation signal based on transition timing data including data pertaining to a turn-on timing at which a state of a light source is changed from a turn-off state to a turn-on state and a turn-off timing at which the state of the light source is changed from the turn-on state to the turn-off state by inputting any one of the high-frequency clock signals for a predetermined period including the turn-on timing and the turn-off timing.

6 Claims, 29 Drawing Sheets

FIG.7

| PIXEL DATA | svalid | sdata | rvalid | rdata |
|---|---|---|---|---|
| 000000 | 0 | 000000 | 0 | 000000 |
| 000001 | 1 | 000000 | 1 | 000001 |
| 000010 | 1 | 000000 | 1 | 000010 |
| 000011 | 1 | 000000 | 1 | 000011 |
| 000100 | 1 | 000000 | 1 | 000100 |
| 000101 | 1 | 000000 | 1 | 000101 |
| 000110 | 1 | 000000 | 1 | 000110 |
| 000111 | 1 | 000000 | 1 | 000111 |
| 001000 | 1 | 000000 | 1 | 001000 |
| 001001 | 1 | 000000 | 1 | 001001 |
| 001010 | 1 | 000000 | 1 | 001010 |
| 001011 | 1 | 000000 | 1 | 001011 |
| 001100 | 1 | 000000 | 1 | 001100 |
| 0010101 | 1 | 000000 | 1 | 0010101 |
| ⋮ | | | | ⋮ |
| 110111 | 1 | 000000 | 1 | 110111 |
| 111000 | 1 | 000000 | 1 | 111000 |
| 111001 | 1 | 000000 | 1 | 111001 |
| 111010 | 1 | 000000 | 1 | 111010 |
| 111011 | 1 | 000000 | 1 | 111011 |
| 111100 | 1 | 000000 | 1 | 111100 |
| 111101 | 1 | 000000 | 1 | 111101 |
| 111110 | 1 | 000000 | 1 | 111110 |
| 111111 | 1 | 000000 | 1 | 111111 |

| det_qt[3:0] | | | | p_pos[4:0] | | | | |
|---|---|---|---|---|---|---|---|---|
| det_qt[3] | det_qt[2] | det_qt[1] | det_qt[0] | p_pos[4] | p_pos[3] | p_pos[2] | p_pos[1] | p_pos[0] |
| 0 | 0 | 0 | 1 | 0 | 0 | 0 | 0 | 0 |
| 0 | 0 | 1 | 0 | 0 | 1 | 0 | 0 | 0 |
| 0 | 1 | 0 | 0 | 1 | 0 | 0 | 0 | 0 |
| 1 | 0 | 0 | 0 | 1 | 1 | 0 | 0 | 0 |

FIG.20A
| g_sdata | p_pos[4:0] | s_pos[6:0] |
|---|---|---|
| 000000 | 10000 | 0010000 |
FIG.20B
| g_rdata | p_pos[4:0] | r_pos[6:0] |
|---|---|---|
| 011000 | 10000 | 0101000 |
FIG.21
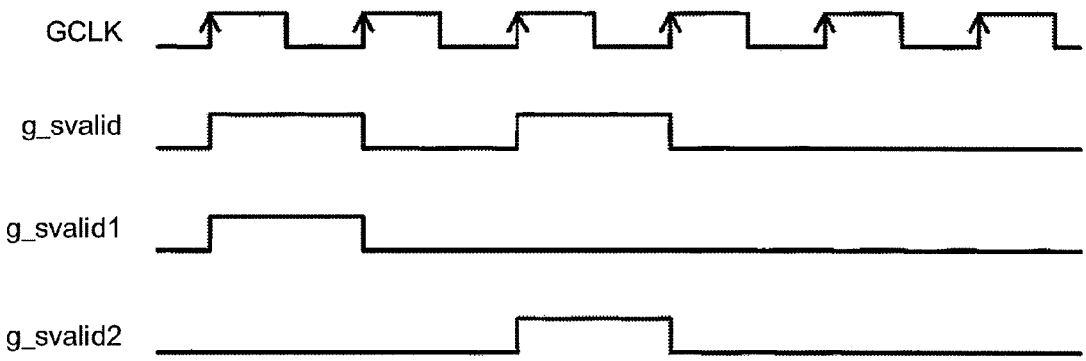
FIG.22
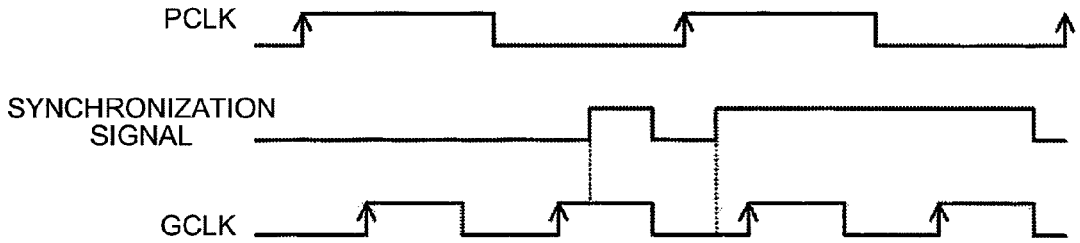

PULSE-MODULATION-SIGNAL GENERATING DEVICE, LIGHT-SOURCE DEVICE, AND OPTICAL SCANNING DEVICE

CROSS-REFERENCE TO RELATED APPLICATIONS

The present application is a continuation of application Ser. No. 12/360,573 filed on Jan. 27, 2009, now U.S. Pat. No. 8,194,113 the entire disclosure of which is incorporated herein by reference and claims priority to and incorporates by reference the entire contents of Japanese priority document 2008-040766 filed in Japan on Feb. 22, 2008.

BACKGROUND OF THE INVENTION

1. Field of the Invention

The present invention relates to a technology for generating a pulse modulation signal for driving a light source.

2. Description of the Related Art

Optical scanning devices are widely used in image forming apparatuses such as optical printers, digital copiers, and optical plotters. A typical optical scanning device scans a target surface with light modulated according to image data. By this scanning, a latent image corresponding to the image data is formed on the target surface.

The optical scanning device typically drives a light source by using a modulation signal of which pulse is modulated according to image data so that the light source emits light that is modulated according to image data. Examples of such an optical scanning device are disclosed in Japanese Patent No. 3515087 and Japanese Patent No. 3372564.

Reduction in power consumption of image forming apparatuses has been increasingly demanded in recent years. In response to these demands, a reduction in power consumption of optical scanning devices has been attempted. However, a pulse-modulation signal generating circuit disclosed in Japanese Patent No. 3515087 and a signal generation device disclosed in Japanese Patent No. 3372564 are disadvantageous in terms of power consumption. More specifically, in the conventional techniques, because a larger number of light emitting units is required in a light source or a larger number of bit count and data lines is required to form an image at a higher resolution, power consumption can increase. It is also conceivable that even an additional cooling mechanism is required.

SUMMARY OF THE INVENTION

It is an object of the present invention to at least partially solve the problems in the conventional technology.

According to one aspect of the present invention, there is provided a pulse-modulation-signal generating device that generates a pulse modulation signal for driving a light source to emit a pulsed light according to input image data. The pulse-modulation-signal generating device includes a high-frequency clock generating circuit that generates a plurality of high-frequency clock signals having different phases; and a modulation-signal generating circuit that generates the pulse modulation signal based on transition timing data including timing data pertaining to a turn-on timing at which a state of the light source is changed from a turn-off state to a turn-on state and a turn-off timing at which the state of the light source is changed from the turn-on state to the turn-off state by inputting any one of the high-frequency clock signals for a predetermined period including the turn-on timing and the turn-off timing.

Furthermore, according to another aspect of the present invention, there is provided a light-source device that emits a light modulated according to input image data. The light-source device includes a light source that emits a light; and a pulse-modulation-signal generating device that generates a pulse modulation signal for driving the light source to emit a pulsed light according to the input image data. The pulse-modulation-signal generating device includes a high-frequency clock generating circuit that generates a plurality of high-frequency clock signals having different phases, and a modulation-signal generating circuit that generates the pulse modulation signal based on transition timing data including timing data pertaining to a turn-on timing at which a state of the light source is changed from a turn-off state to a turn-on state and a turn-off timing at which the state of the light source is changed from the turn-on state to the turn-off state by inputting any one of the high-frequency clock signals for a predetermined period including the turn-on timing and the turn-off timing.

Moreover, according to still another aspect of the present invention, there is provided an optical scanning device that scans a target surface with a light. The optical scanning device includes a light-source device that emits a light modulated according to input image data, which includes a light source that emits a light, and a pulse-modulation-signal generating device that generates a pulse modulation signal for driving the light source to emit a pulsed light according to the input image data; a deflector that deflects the light emitted from the light source; and a scanning optical system that focuses a deflected light deflected by the deflector on the target surface. The pulse-modulation-signal generating device includes a high-frequency clock generating circuit that generates a plurality of high-frequency clock signals having different phases, and a modulation-signal generating circuit that generates the pulse modulation signal based on transition timing data including timing data pertaining to a turn-on timing at which a state of the light source is changed from a turn-off state to a turn-on state and a turn-off timing at which the state of the light source is changed from the turn-on state to the turn-off state by inputting any one of the high-frequency clock signals for a predetermined period including the turn-on timing and the turn-off timing;

Moreover, according to still another aspect of the present invention there is provided an image forming apparatus including at least one image carrier on which an electrostatic latent image is formed; and at least one optical scanning device according to the present invention. The optical scanning device scans the at least one image carrier with the light modulated according to the input image data.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a correspondence table between pixel data shown FIG. 6 and transition timing data;

FIG. 20A is a table for explaining s_pos[6:0];

FIG. 20B is a table for explaining r_pos[6:0];

FIG. 21 is a timing chart for explaining how an allocating circuit shown in FIG. 18 operates;

FIG. 22 is a timing chart for explaining why allocation of g_svalid is performed;

DETAILED DESCRIPTION OF THE PREFERRED EMBODIMENTS

Figure 1:
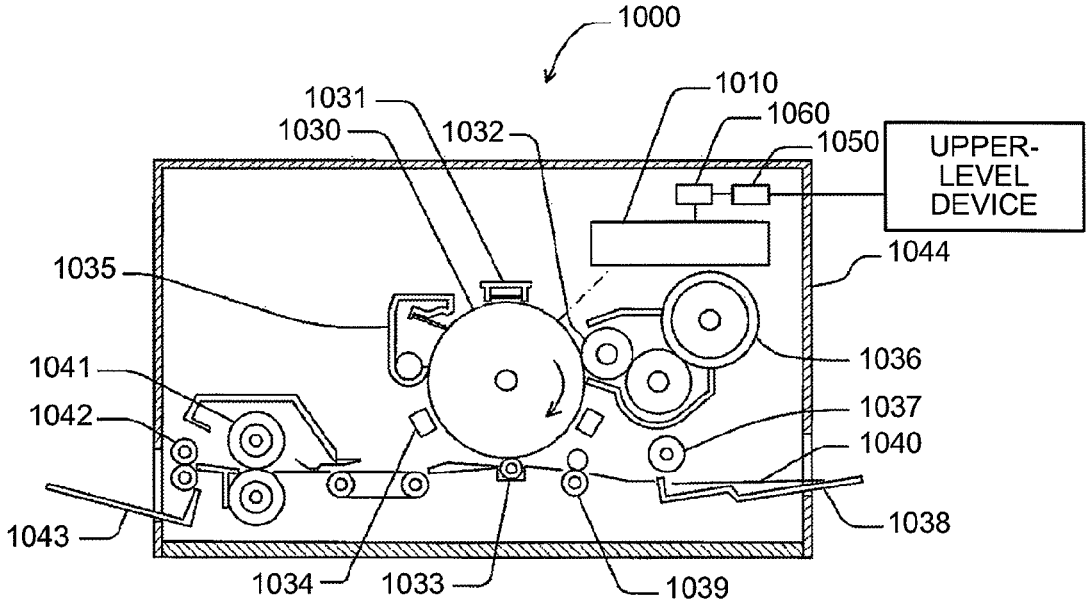
FIG. 1 is a schematic diagram of a laser printer according to an embodiment of the present invention.

Exemplary embodiments of the present invention are described in detail below with reference to the accompanying drawings. FIG. 1 is a schematic diagram of a laser printer 1000 as an example of an image forming apparatus according to an embodiment of the present invention.

The laser printer 1000 includes an optical scanning device 1010, a photosensitive drum 1030, an electrifying charger 1031, a developing roller 1032, a transfer charger 1033, a charge removing unit 1034, a cleaning unit 1035, a toner cartridge 1036, a paper feeding roller 1037, a paper feed tray 1038, a pair of registration rollers 1039, a pair of fixing rollers 1041, a pair of paper output rollers 1042, a paper stacking tray 1043, a communication control device 1050, and a printer control device 1060. The printer control device 1060 controls these units. These units are housed and arranged at predetermined positions in a printer casing 1044.

The communication control device 1050 controls communications to and from an upper-level device (for example, a personal computer (PC)) through a network or the like.

The photosensitive drum 1030, which is a cylindrical member, has a photosensitive layer on its surface. In other words, the surface of the photosensitive drum 1030 is to be scanned. The photosensitive drum 1030 rotates in a direction indicated by an arrow of FIG. 1.

The electrifying charger 1031, the developing roller 1032, the transfer charger 1033, the charge removing unit 1034, and the cleaning unit 1035 are arranged near the surface of the photosensitive drum 1030 and along the rotating direction of the photosensitive drum 1030 in this order.

The electrifying charger 1031 uniformly electrifies the surface of the photosensitive drum 1030.

The optical scanning device 1010 modulates a light flux according to image data received from the upper-level device and emits the modulated light flux against the electrified surface of the photosensitive drum 1030. Consequently, a latent image corresponding to the image data is formed on the surface of the photosensitive drum 1030. The formed latent image is moved to a position corresponding to the developing roller 1032 by rotation of the photosensitive drum 1030. The structure of the optical scanning device 1010 will be described later.

The toner cartridge 1036 houses toner. The toner is supplied to the developing roller 1032.

The toner supplied from the toner cartridge 1036 is caused to stick to the surface of the developing roller 1032 to develop the latent image on the surface into a visible image (hereinafter, "toner image"). The toner image is moved to a position corresponding to the transfer charger 1033 by rotation of the photosensitive drum 1030.

The paper feeding roller 1037 is arranged near the paper feed tray 1038 in which a recording medium 1040 is housed. The paper feeding roller 1037 picks up a sheet of the recording medium 1040 from the paper feed tray 1038 and conveys the recording medium 1040 to the registration rollers 1039. The registration rollers 1039 temporarily hold the recording medium 1040 and feed it to a nip between the photosensitive drum 1030 and the transfer charger 1033 in timed relation to rotation of the photosensitive drum 1030.

The transfer charger 1033 is electrified with a reversed polarity from that of the toner so that the toner on the surface of the photosensitive drum 1030 is electrically attracted to the recording medium 1040. By this attraction, the toner image on the surface of the photosensitive drum 1030 is transferred onto the recording medium 1040. The recording medium 1040 carrying the toner image thereon is then delivered to the fixing rollers 1041.

Heat and pressure are applied to the recording medium 1040 at a nip between the fixing rollers 1041. The recording medium 1040 onto which the toner image is fixed is delivered by the paper output rollers 1042 to the paper stacking tray 1043 and stacked in the paper stacking tray 1043.

The charge removing unit 1034 removes electrical charges from the surface of the photosensitive drum 1030.

The cleaning unit 1035 removes residual toner on the surface of the photosensitive drum 1030. The surface of the photosensitive drum 1030 from which the residual toner has been cleaned returns to a position opposed to the electrifying charger 1031.

The structure of the optical scanning device 1010 will be described below.

Figure 2:
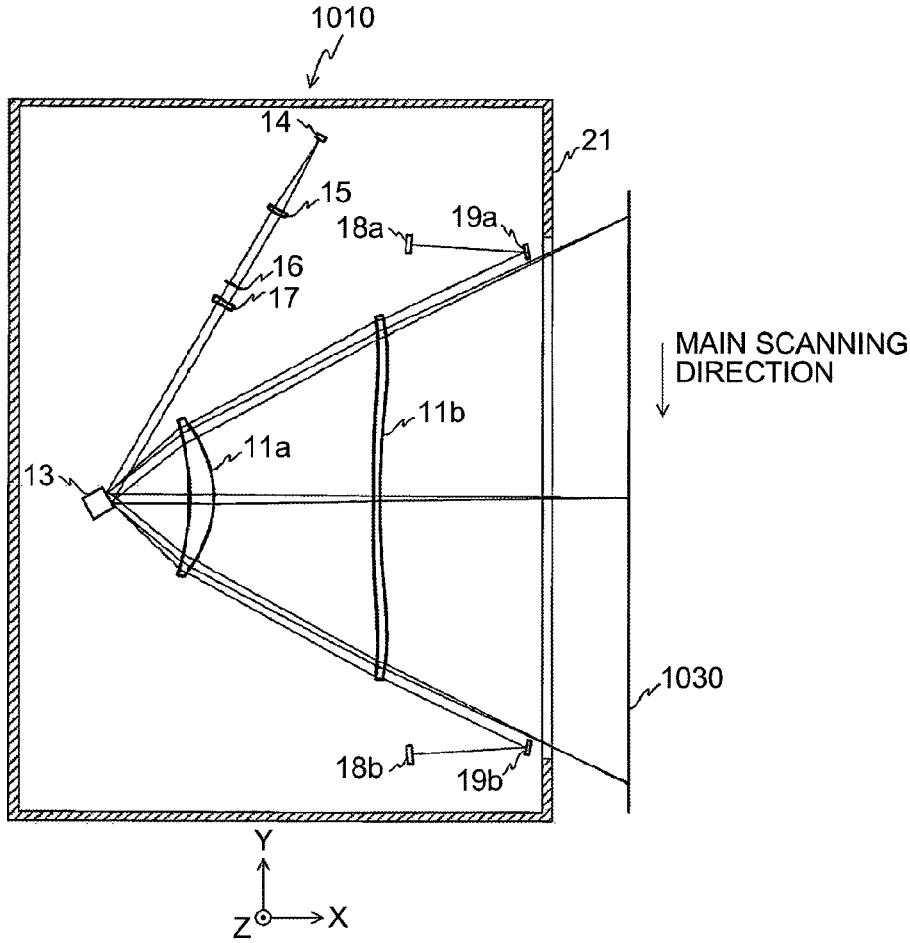
FIG. 2 is a schematic diagram of a portion of an optical scanning device shown in FIG. 1.
Figure 4:
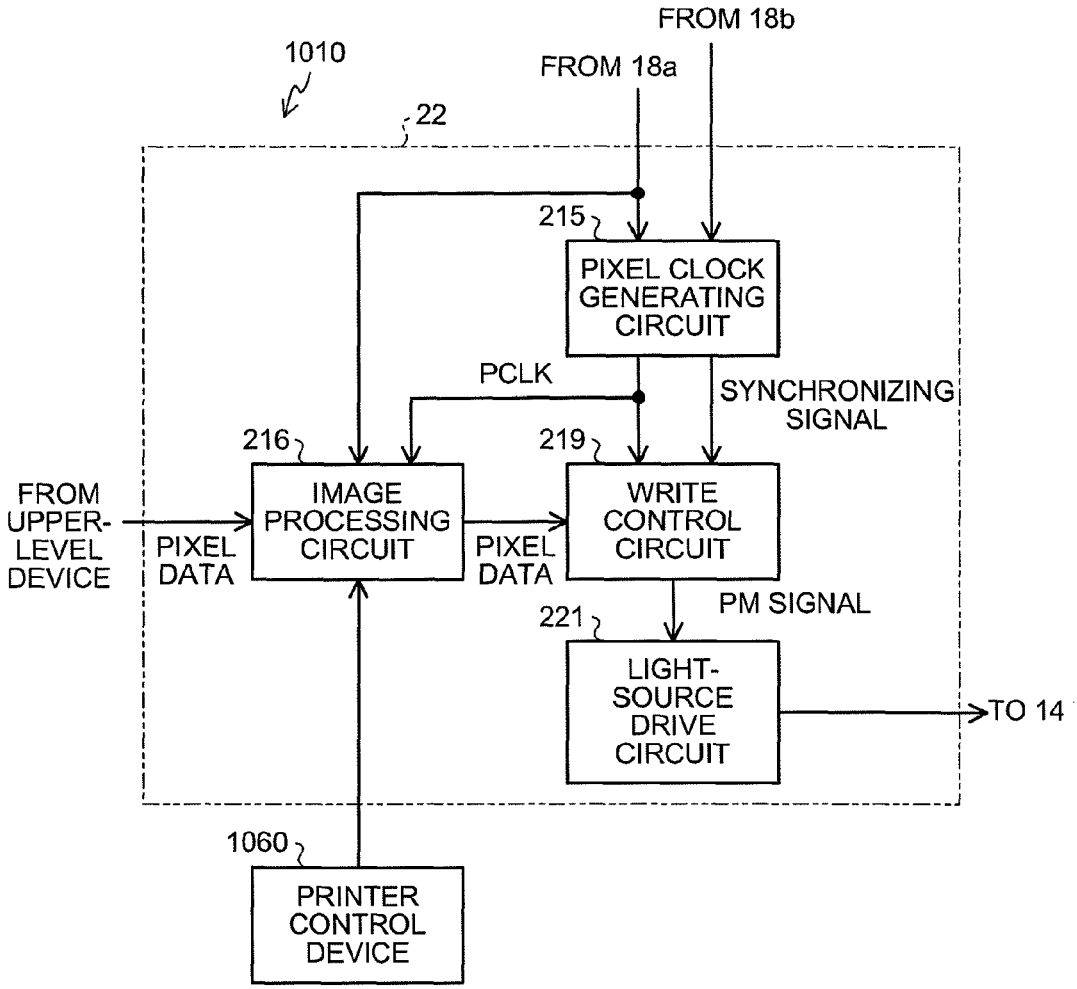
FIG. 4 is a schematic block diagram of a scanning control device in the optical scanning device shown in FIG. 1.

As shown in FIG. 2, the optical scanning device 1010 includes a light source 14, a coupling lens 15, an aperture plate 16, a cylindrical lens 17, a polygon mirror 13, a first scanning lens 11*a*, and a second scanning lens 11*b*, a photodetector 18*a*, a photodetector 18*b*, a photodetector mirror 19*a*, a photodetector mirror 19*b*, and a scanning control device 22 (not shown in FIG. 2, but in FIG. 4). The first scanning lens 11*a* is arranged close to the polygon mirror 13 while the second scanning lens 11*b* is arranged close to an image surface. The image surface is on the surface of the photosensitive drum 1030. These members are arranged at predetermined positions in a housing 21.

In the present description, the XYZ orthogonal coordinate system is defined such that a longitudinal direction of the photosensitive drum 1030 is the Y-direction, and the optical axes of the first scanning lens 11*a* and the second scanning lens 11*b* extend in the X-direction.

Figure 3:
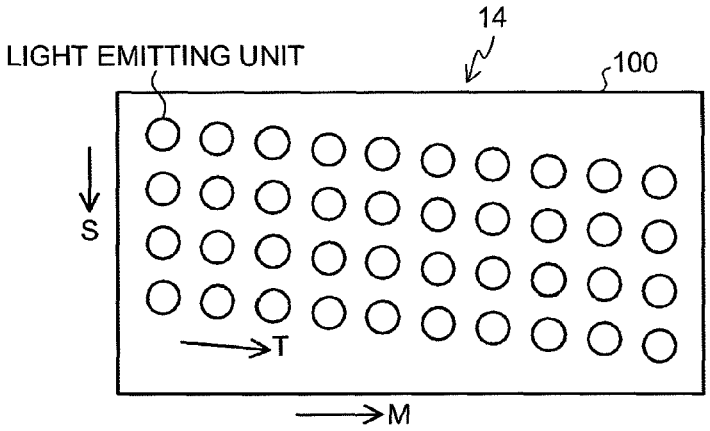
FIG. 3 is a schematic diagram of a two-dimensional array of a VCSEL in a light source shown in FIG. 2.

The light source 14 includes a two-dimensional array 100. An example of the two-dimensional array 100 that is formed of 40 light emitting units is shown in FIG. 3. The light emitting units are two-dimensionally arranged on a substrate. The direction indicated by an arrow M in FIG. 3 is the main-scanning direction, while the direction indicated by an arrow S is the sub-scanning direction (i.e., the Z-direction). The direction indicated by an arrow T is a direction that makes an inclination angle $\alpha$ ($0° < \alpha < 90°$) with the direction M in the direction S.

The two-dimensional array 100 has four lines each of which has ten light emitting units spaced at regular intervals in the direction T. The four lines are spaced at regular intervals in the direction S. More specifically, the four lines are arranged such that orthogonal projections of the four lines are spaced at regular intervals on a vertical line that extends in the direction S. Hereinafter, a distance between centers of two light emitting units will be referred to as "light-emitting unit interval".

Each of the light emitting units is a 780-nm vertical-cavity surface-emitting laser (VCSEL). Put another way, the two-dimensional array 100 is a surface-emitting laser array that includes 40 light emitting units.

As shown in FIG. 2, the coupling lens 15 collimates a light flux emitted from the light source 14.

The aperture plate 16 has an aperture that defines a beam diameter of the collimated light flux.

After passing through the aperture, the collimated light flux passes through the cylindrical lens 17. The cylindrical lens 17 converges the light flux to form an image in the sub-scanning direction (i.e., the Z-direction) near the polygon mirror 13.

The optical system arranged on an optical path of the light flux between the light source 14 and the polygon mirror 13 is referred to as a pre-deflector optical system in some cases. In this embodiment, the pre-deflector optical system includes the coupling lens 15, the aperture plate 16, and the cylindrical lens 17.

The polygon mirror 13 has four side surface mirrors. Each of the side surface mirrors serves as a deflective reflection surface by which a light flux emerging from the cylindrical lens 17 is deflected. The polygon mirror 13 rotates about an axis extending in the sub-scanning direction at a constant velocity.

The first scanning lens 11*a* is arranged on the optical path downstream of the polygon mirror 13.

The second scanning lens 11*b* is arranged on the optical path downstream of the first scanning lens 11*a*. The light flux that emerges from the second scanning lens 11*b* impinges on the surface of the photosensitive drum 1030 to form a spot of light on the surface. This light spot is moved in the longitudinal direction of the photosensitive drum 1030 by rotation of the polygon mirror 13. In other words, the light spot scans the surface of the photosensitive drum 1030. The direction in which the light spot is moved for scanning is the main-scanning direction.

The optical system arranged on the optical path between the polygon mirror 13 and the photosensitive drum 1030 is referred to as a scanning optical system in some cases. In this embodiment, the scanning optical system includes the first scanning lens 11*a* and the second scanning lens 11*b*. The scanning optical system can include a reflection mirror on the optical path at one of a position between the first scanning lens 11*a* and the second scanning lens 11*b* and a position between the second scanning lens 11*b* and the photosensitive drum 1030.

A portion of the light flux having been deflected by the polygon mirror 13 and emerges from the scanning optical system is caused to impinge on the photodetector 18*a* by the photodetector mirror 19*a*. The photodetector mirror 19*a* is arranged upstream of the image surface in the main-scanning position. Another portion of the light flux is caused to impinge on the photodetector 18*b* by the photodetector mirror 19*b*. The photodetector mirror 19*b* is arranged downstream of the image surface in the main-scanning position.

Each of the photodetector 18*a* and the photodetector 18*b* generates an electrical signal (photoelectric conversion signal) according to an intensity of received light, and sends the electrical signal to the scanning control device 22.

The scanning control device 22 includes, for example, a pixel-clock generating circuit 215, an image processing circuit 216, a write control circuit 219, and a light-source drive circuit 221 as shown in FIG. 4. It should be noted that arrows in FIG. 4 indicate only flows of relevant signals and data rather than all connections between the blocks.

The pixel-clock generating circuit 215 receives output signals from the photodetector 18*a* and the photodetector 18*b*, and obtains a period of time required by the light flux to scan one stroke from the photodetector 18*a* to the photodetector 18*b*. The pixel-clock generating circuit 215 generates a pixel clock signal PCLK that has such a frequency that a predetermined number of pulses occur in the obtained period at the frequency. PCLK is fed to the image processing circuit 216 and to the write control circuit 219. An output signal of the photodetector 18*a* is fed to the write control circuit 219 as a synchronization signal.

The image processing circuit 216 receives image data from the upper-level device via the printer control device 1060. By performing rasterization and predetermined half-tone processing of the image data, the image processing circuit 216 generates pixel data that represents a tone of each pixel for each of the light emitting units based on PCLK. When the image processing circuit 216 determines that scanning is started based on an output signal of the photodetector 18*a*, the image processing circuit 216 outputs the pixel data to the write control circuit 219 in synchronization with PCLK.

The write control circuit 219 receives the pixel data from the image processing circuit 216 and receives PCLK and the synchronization signal from the pixel-clock generating circuit 215, and generates a pulse modulation (PM) signal based on these signals and data. The structure of the write control circuit 219 will be described later.

The light-source drive circuit 221 receives the PM signal from the write control circuit 219, and drives each of the light emitting units in the two-dimensional array 100 based on the PM signal.

Write Control Circuit

Figure 5:
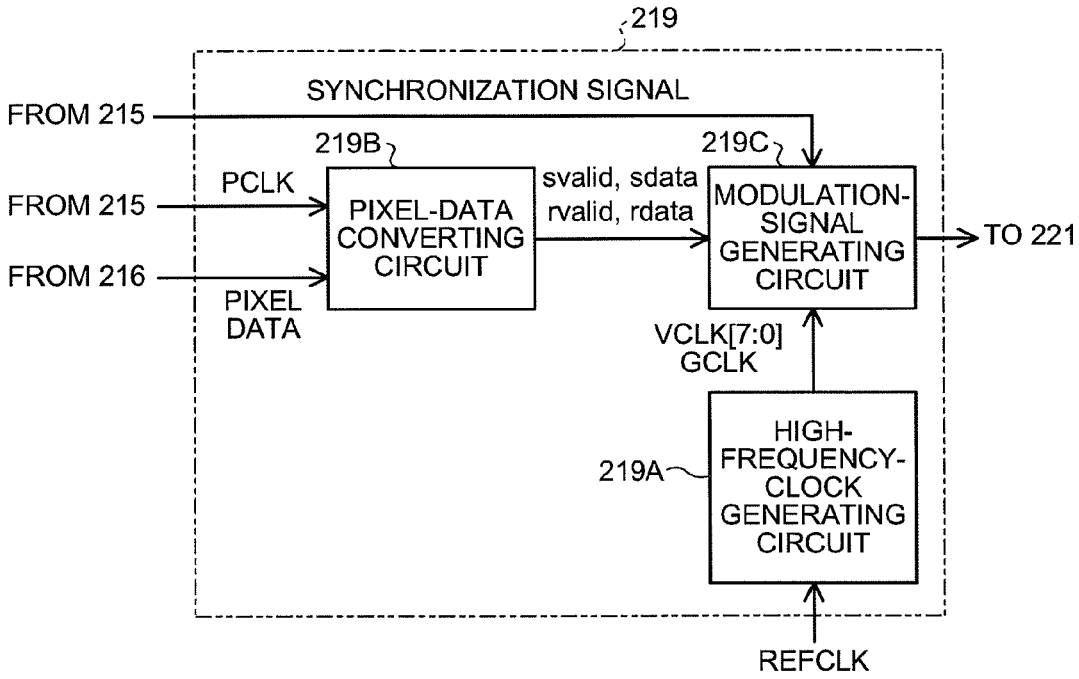
FIG. 5 is a schematic diagram of a write control circuit shown in FIG. 4.

The write control circuit 219 includes, for example, a high-frequency-clock generating circuit 219A, a pixel-data converting circuit 219B, and a modulation-signal generating circuit 219C as shown in FIG. 5.

The pixel-data converting circuit 219B converts the pixel data into transition timing data on a pixel-by-pixel basis. The transition timing data includes four data elements (svalid, sdata, rvalid, and rdata). Of the transition timing data, svalid indicates whether a light emitting unit is to be activated (hereinafter, "set") while sdata is data pertaining to timing for set (light-on). Similarly, rvalid indicates whether a light emitting unit is to be deactivated (hereinafter, "reset") while rdata is data pertaining to timing for reset (light-off).

Figure 6:
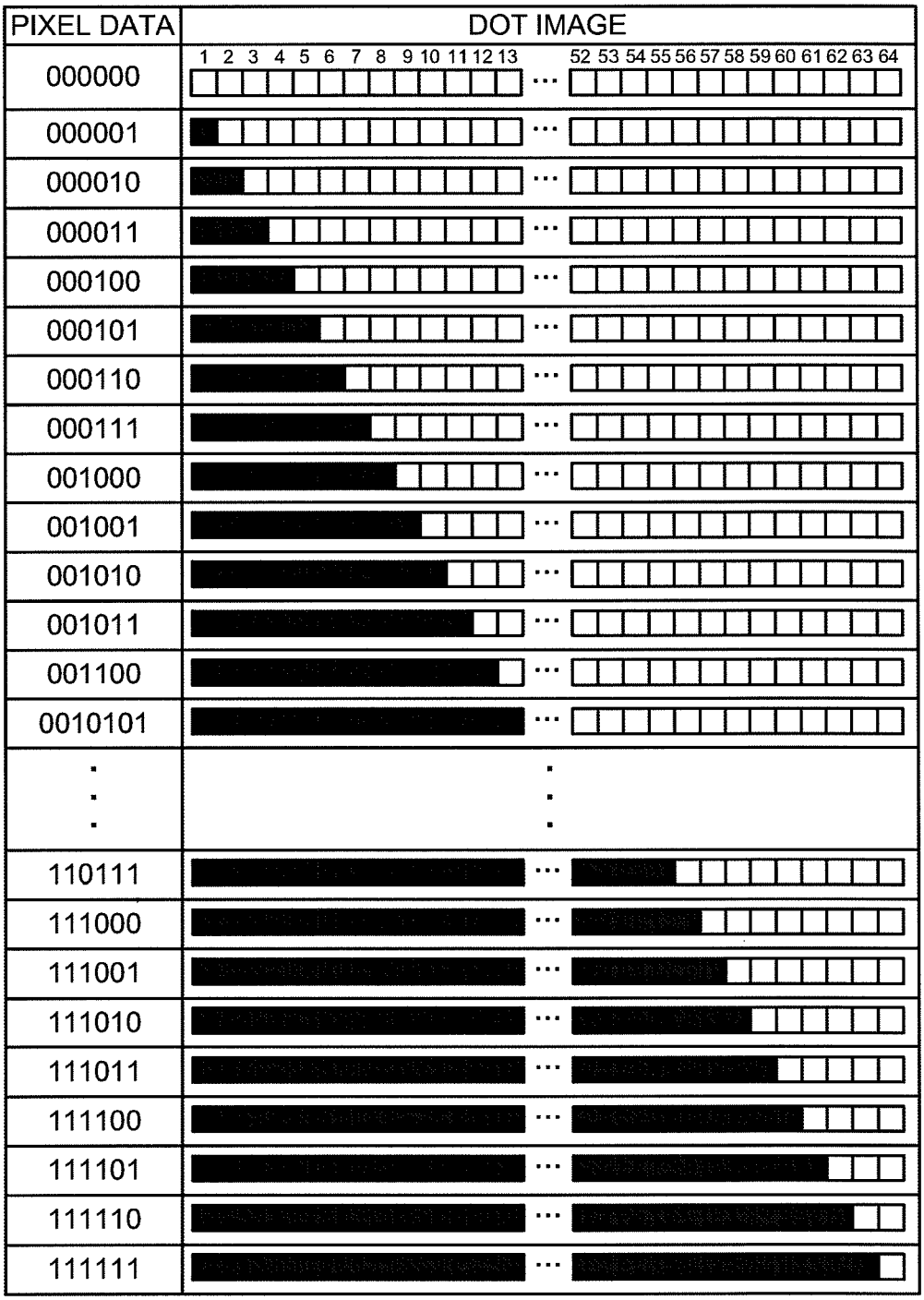
FIG. 6 is a schematic diagram for explaining pixel data.

When one pixel is divided in, for example, 64 in the main-scanning direction, pixel data for this pixel can be represented with 6 bits (see FIG. 6). FIG. 6 is a schematic diagram for explaining relation between pixel data and dot image in, e.g., a left-to-right mode. In the left-to-right mode, a filled area increases from the left to the right as the value of pixel data increases.

FIG. 7 is a correspondence table between the pixel data shown FIG. 6 and the transition timing data.

While values of svalid and rvalid are "1" when a filled area exists, values of svalid and rvalid are "0" when a filled area does not exist. In short, the values of svalid and rvalid are "0" only when the pixel data is "000000".

In the left-to-right mode, a set position is on the left end without fail. Accordingly, if a filled area exists, sdata is "000000" without fail. A reset position is determined by the value of pixel data. The value of pixel data is identical with the value of rdata.

A center mode in which a filled area increases from a center as the value of pixel data increases, or a right-to-left mode in which a filled area increases from the right to the left as the value of pixel data increases can be employed in place of the left-to-right mode. In the right-to-left mode, a reset position is on the right end without fail (i.e., a position of "000000" of a subsequent pixel). Accordingly, when a filled area exists, rdata is "000000" without fail. A set position is determined by the value of pixel data, and the value of sdata is a two's-complement number of the value of the pixel data. In the center mode, when a filled area exists, a set position and a reset position are determined by the value of pixel data. For the center mode, a look-up table that can be referred to for correspondence between the values of pixel data and set and reset positions can be stored in advance to accelerate conversion.

As shown in FIG. 5, the high-frequency-clock generating circuit 219A receives a reference clock signal REFCLK that has a reference frequency, and generates a plurality of relatively-high-frequency clock signals. The phases of the high-frequency clock signals differ from one another.

Figure 8:
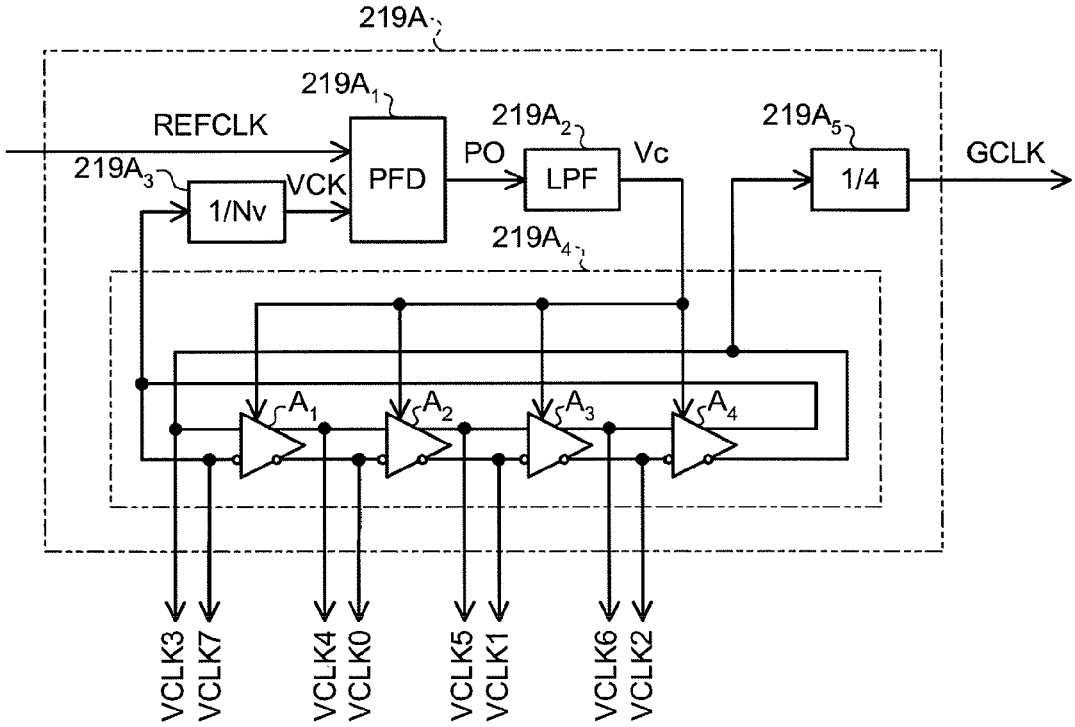
FIG. 8 is a schematic diagram of a high-frequency-clock generating circuit shown in FIG. 5.

The high-frequency-clock generating circuit 219A includes, for example, a phase frequency detector (PFD) 219$A_1$, a low-pass filter (LPF) 219$A_2$, a frequency divider (1/Nv) 219$A_3$, a voltage controlled oscillator (VCO) 219$A_4$, and a frequency divider (¼) 219$A_5$ as shown in FIG. 8.

The PFD 219$A_1$ compares phases of REFCLK and an output signal of the frequency divider 219$A_3$, and generates an output signal that indicates the phase difference between these signals.

The LPF 219$A_2$ receives the output signal from the PFD 219$A_1$ and converts the output signal by smoothing into an analog voltage signal Vc.

The VCO 219$A_4$ is a four-stage ring oscillator that includes four differential buffers ($A_1$ to $A_4$). The VCO 219$A_4$ changes an oscillation frequency by Vc. In the example shown in FIG. 8, the VCO 219$A_4$ outputs eight high-frequency clock signals (VCLK7 to VCLK0: hereinafter, collectively "VCLK[7:0]") that have different phases. VCLK[7:0] will be simply referred to as "VCLK" when it is not necessary to discriminate each of VCLK[7:0].

VCLK7 is fed also to the frequency divider 219$A_3$. VCLK3 is fed also to the frequency divider 219$A_5$.

The frequency divider 219$A_3$ divides the frequency of VCLK7 by Nv.

More specifically, the PFD 219$A_1$, the LPF 219$A_2$, the frequency divider 219$A_3$, and the VCO 219$A_4$ form a phase locked loop (PLL). This PLL allows the frequency of the high-frequency clock signal to be set by using the frequency of REFCLK and the value of Nv of the frequency divider 219$A_3$.

The frequency divider 219$A_5$ divides VCLK3 by four, and outputs the divided signal as a clock signal GCLK. GCLK serves as a reference clock signal in generation of a PM signal. GCLK is in synchronization with VLCK3, and output after a delay relative to VLCK3 corresponding to an analog delay caused by the frequency division.

Figure 9:
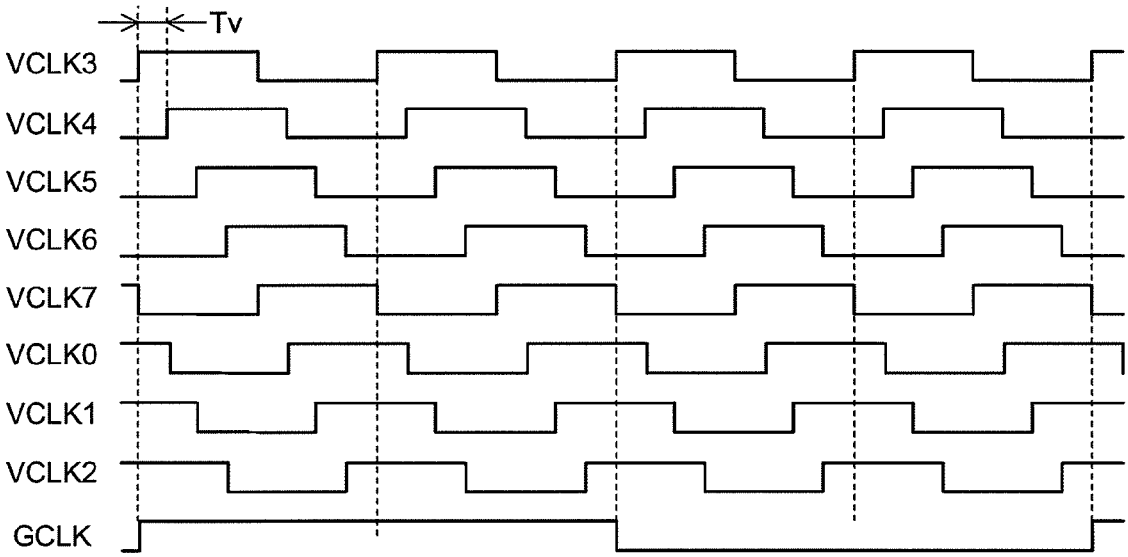
FIG. 9 is a timing chart of VCLK[7:0] and GCLK generated by the high-frequency-clock generating circuit shown in FIG. 8.

FIG. 9 is a timing chart of VCLK[7:0] and GCLK. VCLK[7:0] are multiphase clock signals. More specifically, phases of consecutive two signals of VCLK[7:0] differ from each other by Tv. For example, when the frequency of VLCK is 1 gigahertz, Tv is 125 picoseconds and the frequency of GCLK is 250 megahertz. In other words, the clock cycle time of GCLK is 4 nanoseconds. It should be noted that analog delay caused by frequency division of VCLK3 is not taken into consideration in the timing chart.

Figure 10:
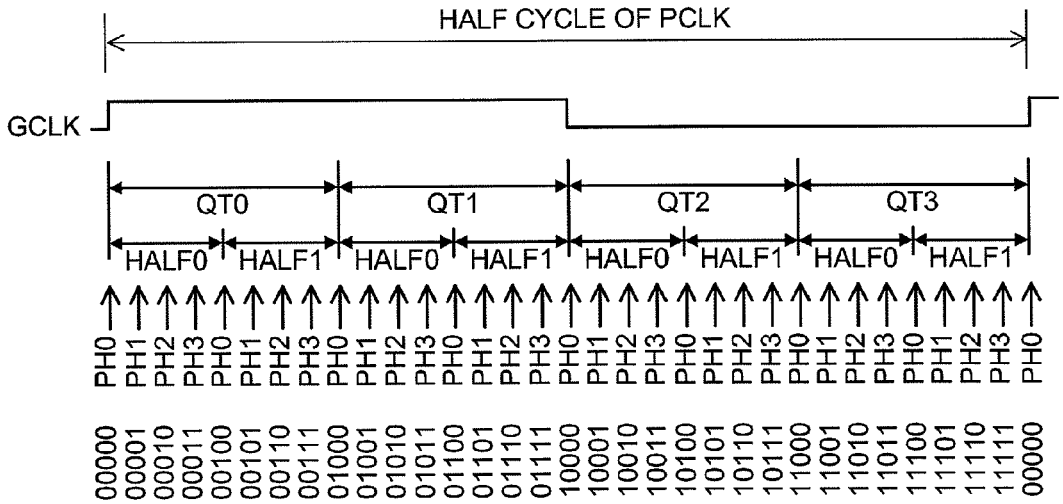
FIG. 10 is a chart for explaining QT, HALF, and PH.

As shown in FIG. 10, in this embodiment, one clock period of GCLK is divided by four (into QT0, QT1, QT2, and QT3). Each QT is further divided by two (into HALF0 and HALF1).

Each HALF is further divided by four (into PH0, PH1, PH2, and PH3). Hence, it is possible to express one of positions in one clock period of GCLK divided by 32 with QT, HALF, and PH. In this embodiment, a set position and a reset position in GCLK are indicated by using QT, HALF, and PH. When, for example, five bits are used to represent a position of a pulse edge, QT can be represented with most significant two bits, PH with least significant two bits, and HALF with a center bit. For example, "10101" indicates a position of QT2, HALF1, and PH1.

In this embodiment, it is assumed that a clock cycle time of GCLK is a half of a clock cycle time of PCLK, and PCLK is constant. Setting the clock cycle time of GCLK to a multiple of the clock cycle time of PCLK simplifies the structure of the high-frequency-clock generating circuit 219A.

As shown in FIG. 5, the modulation-signal generating circuit 219C receives the transition timing data from the pixel-data converting circuit 219B and receives VCLK[7:0] and GCLK from the high-frequency-clock generating circuit 219A, and outputs a PM signal.

Figure 11:
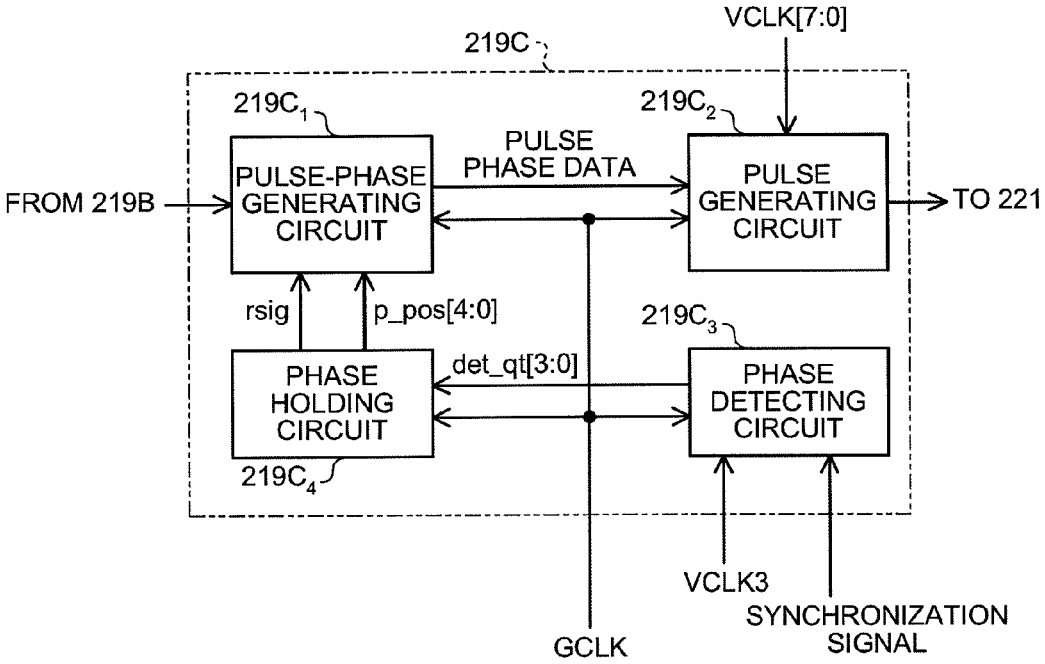
FIG. 11 is a schematic diagram of a modulation-signal generating circuit shown in FIG. 5.

As shown in FIG. 11, the modulation-signal generating circuit 219C includes a pulse-phase generating circuit 219$C_1$, a pulse generating circuit 219$C_2$, a phase detecting circuit 219$C_3$, and a phase holding circuit 219$C_4$.

Figure 12:
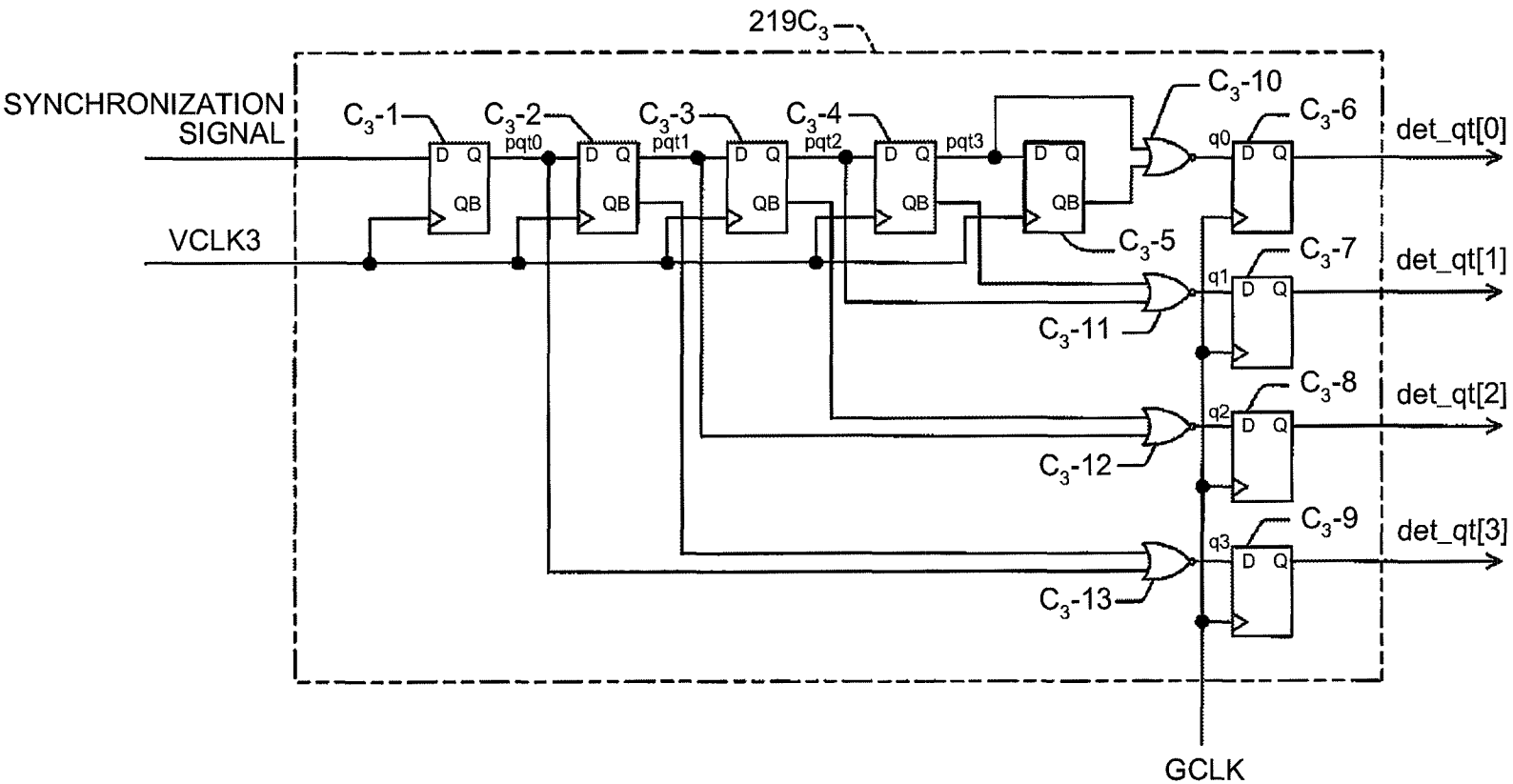
FIG. 12 is a schematic diagram of a phase detecting circuit shown in FIG. 11.

As shown in FIG. 12, the phase detecting circuit 219$C_3$ receives a synchronization signal, VCLK, and GCLK, determines a position of a falling edge of the synchronization signal, and outputs four data elements (det_qt[3], det_qt[2], det_qt[1], and det_qt[0]: hereinafter, collectively "det_qt[3:0]").

Figure 13:
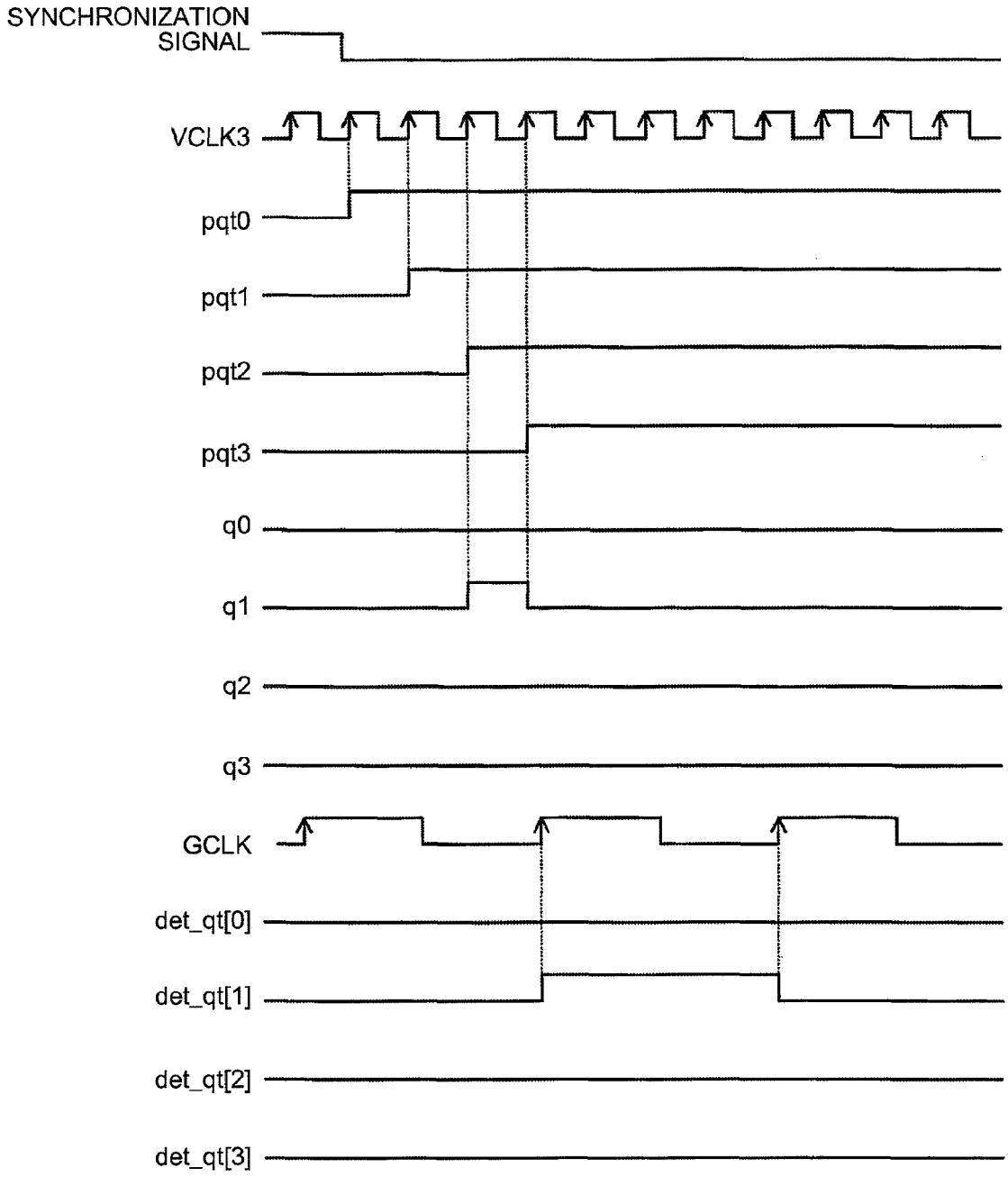
FIG. 13 is a timing chart for explaining how the phase detecting circuit shown in FIG. 12 operates.

The phase detecting circuit 219$C_3$ includes five flip-flops ($C_3$-1 to $C_3$-5) that are driven by GCLK, four flip-flops ($C_3$-6 to $C_3$-9) that are driven by GCLK, and four NOR circuits ($C_3$-10 to $C_3$-13). FIG. 13 is an example of a timing chart for explaining relation between inputs to the flip-flops and det_qt[3:0].

Figures 14, 15:
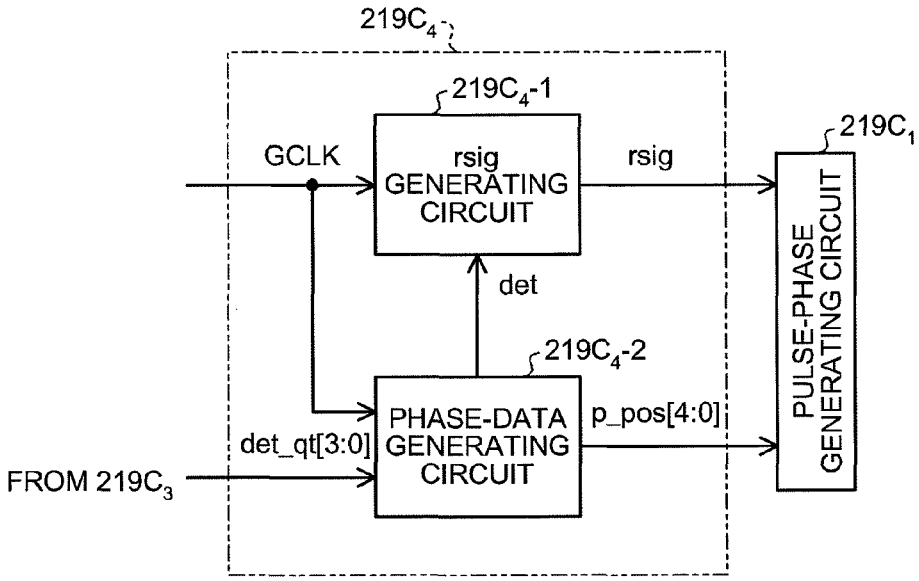
FIG. 14 is a schematic diagram of a phase holding circuit shown in FIG. 11.
FIG. 15 is a correspondence table between det_qt[3:0] and p_pos[4:0]

As shown in FIG. 14, the phase holding circuit 219$C_4$ receives det_qt[3:0] and GCLK, and outputs pixel-clock phase data (p_pos[4], p_pos[3], p_pos[2], p_pos[1], and p_pos[0]: hereinafter, collectively "p_pos[4:0]") and a signal rsig.

The phase holding circuit 219$C_4$ includes an rsig generating circuit 219$C_4$-1 and a phase-data generating circuit 219$C_4$-2.

The phase-data generating circuit 219$C_4$-2 receives GCLK and det_qt[3:0], and generates p_pos[4:0] by referring to a conversion table. In this example, a conversion table shown in FIG. 15 is referred to. According to the conversion table, on receiving det_qt[3:0]=0010, the phase-data generating circuit 219$C_4$-2 outputs p_pos[4:0]=01000. More specifically, on receiving det_qt[3]=0, det_qt[2]=0, det_qt[1]=1, and det_qt[0]=0, the phase-data generating circuit 219$C_4$-2 outputs p_pos[4]=0, p_pos[3]=1, p_pos[2]=0, p_pos[1]=0, and p_pos[0]=0.

The phase-data generating circuit 219$C_4$-2 also ORs det_qt[3:0] and outputs a result of the OR operation as a signal det. More specifically, the phase-data generating circuit 219$C_4$-2 outputs a low-level signal det on receiving det_qt[3:0]=0000, while the phase-data generating circuit 219$C_4$-2 outputs a high-level signal det on receiving det_qt[3:0] that is not 0000.

The rsig generating circuit 219$C_4$-1 receives the signal det and GCLK, and generates a signal rsig. On receiving a high-level signal det, the rsig generating circuit 219$C_4$-1 repeatedly toggles the level of the signal rsig between high and low at intervals of the clock cycle time of GCLK.

Figure 16:
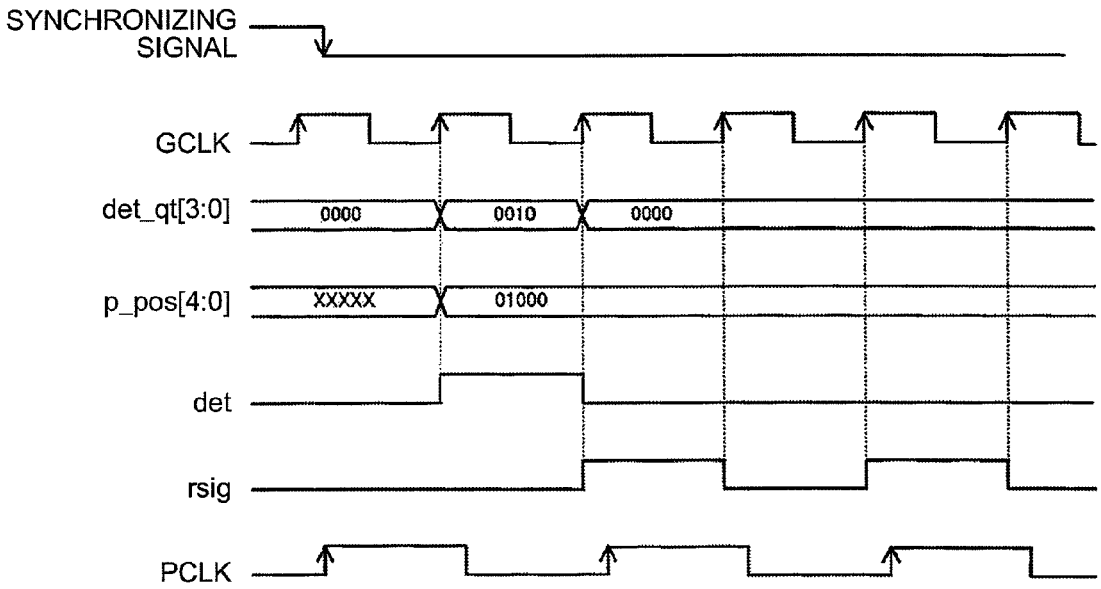
FIG. 16 is a timing chart for explaining how the phase holding circuit shown in FIG. 14 operates.

FIG. 16 is an example of a timing chart for explaining how the phase-data generating circuit 219$C_4$-2 operates. In this embodiment, it is assumed that a position of a falling edge of a synchronization signal coincides with a position of a rising edge of PCLK.

Figure 17:
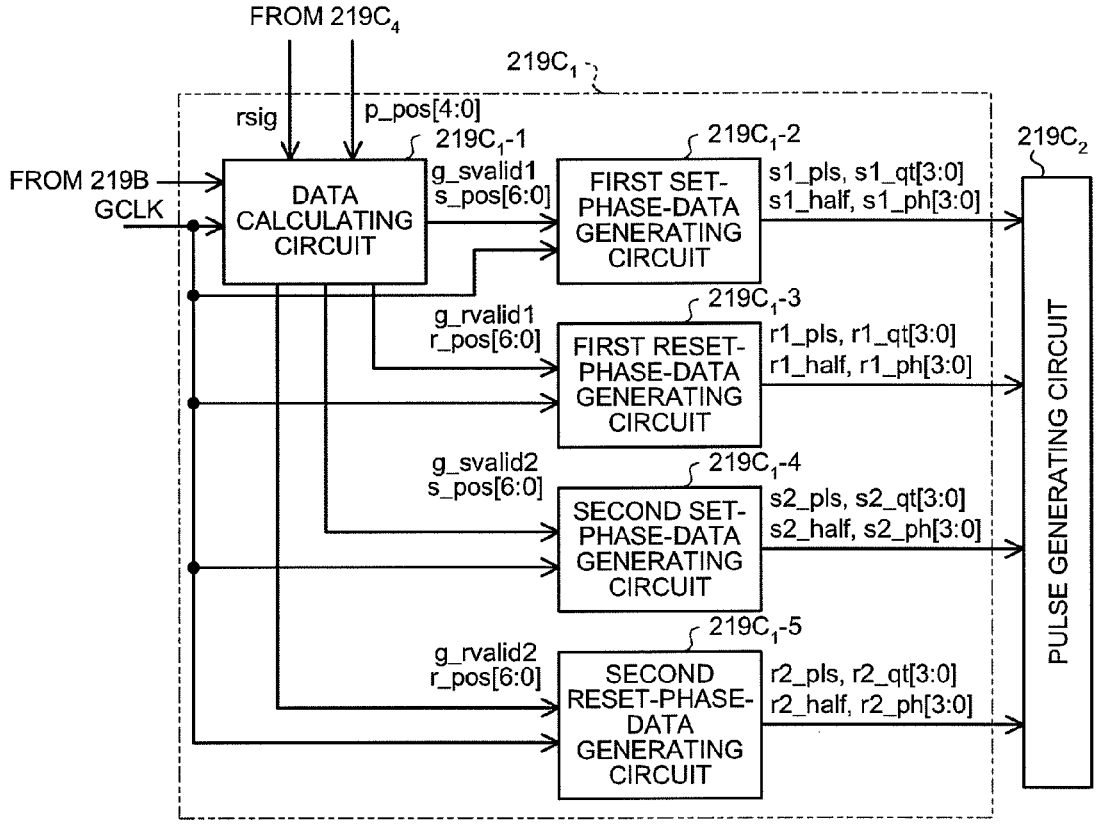
FIG. 17 is a schematic diagram of a pulse-phase generating circuit shown in FIG. 11.

As shown in FIG. 17, the pulse-phase generating circuit 219$C_1$ receives GCLK, the transition timing data (svalid, sdata, rvalid, and rdata), p_pos[4:0], and the signal rsig, and outputs first set-phase data (s1_pls, s1_qt[3:0], s1_half, and s1_ph[3:0]), second set-phase data (s2_pls, s2_qt[3:0], s2_half, and s2_ph[3:0]), first reset-phase data (r1_pls, r1_qt[3:0], r1_half, and r1_ph[3:0]), and second reset-phase data (r2_pls, r2_qt[3:0], r2_half, and r2_ph[3:0]).

The pulse-phase generating circuit 219$C_1$ includes a data calculating circuit 219$C_1$-1, a first set-phase-data generating circuit 219$C_1$-2, a first reset-phase-data generating circuit 219$C_1$-3, a second set-phase-data generating circuit 219$C_1$-4, and a second reset-phase-data generating circuit 219$C_1$-5.

Figure 18:
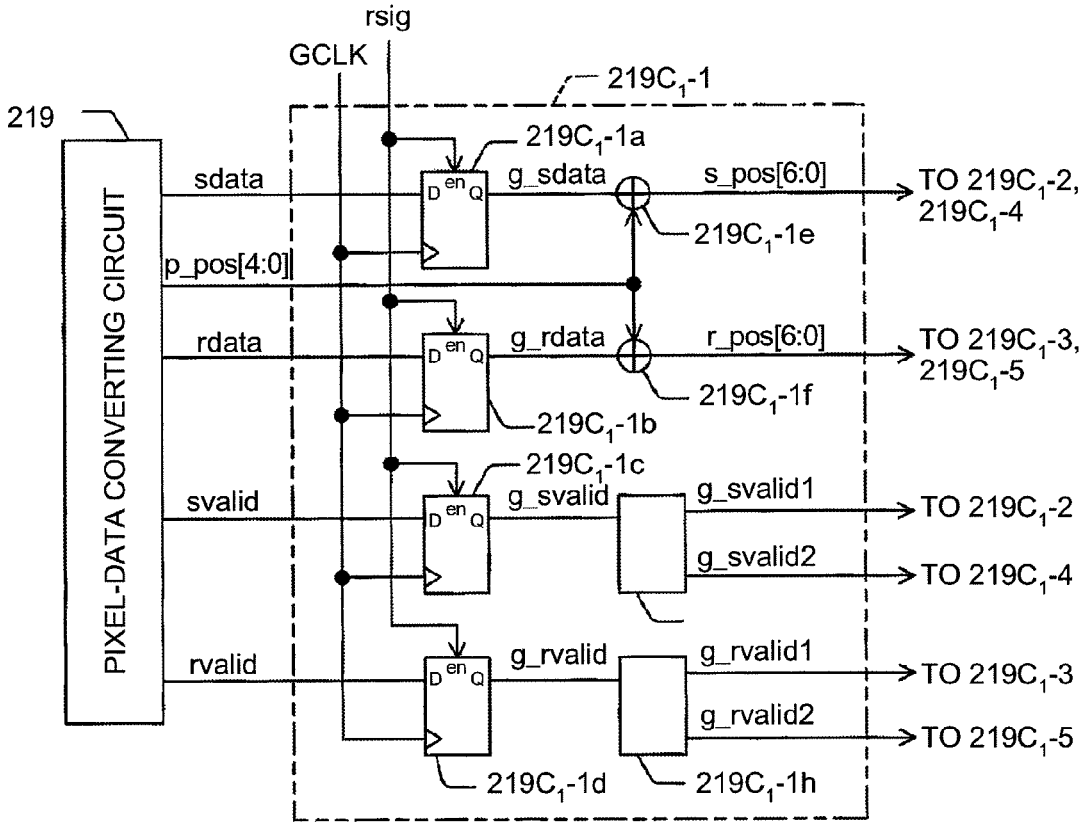
FIG. 18 is a schematic diagram of a data calculating circuit shown in FIG. 17.

As shown in FIG. 18, the data calculating circuit 219$C_1$-1 receives GCLK, the transition timing data, p_pos[4:0], and the signal rsig, and outputs six data elements (s_pos[6:0], r_pos[6:0], g_svalid1, g_svalid2, g_rvalid1, and g_rvalid2).

The data calculating circuit 219$C_1$-1 includes four flip-flops (219$C_1$-1*a* to 219$C_1$-1*d*). A signal rsig is fed to a terminal en of each of the flip-flops 219$C_1$-1*a* to 219$C_1$-1*d*. When an arbitrary one of the flip-flops receives a high-level (H) signal rsig, data input to the flip-flop is enabled. In other conditions, the flip-flop remains to hold the present data.

Figure 19:
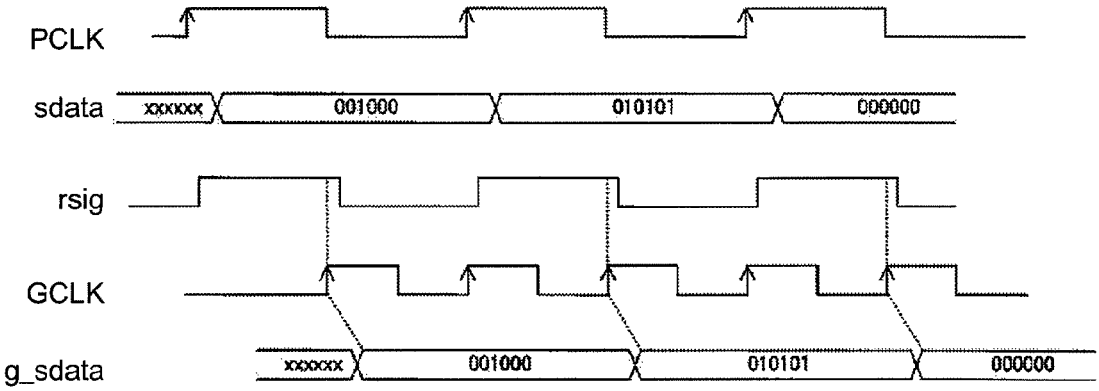
FIG. 19 is a timing chart for explaining how a flip-flop shown in FIG. 18 operates.

The flip-flop 219$C_1$-1*a* receives sdata in synchronization with GCLK, and outputs g_rdata. FIG. 19 is an example of the timing chart that explains how the flip-flop 219$C_1$-1*a* operates.

In this example, because the frequency of GCLK is the double of the frequency of PCLK, the signal rsig is toggled at intervals of the clock cycle time of GCLK. Hence, input of data to the data calculating circuit 219$C_1$-1 is enabled every two risings of GCLK (see FIG. 19).

An adder 219$C_1$-1*e* adds g_sdata, which is output from the flip-flop 219$C_1$-1*a*, to p_pos[4:0], and generates s_pos[6:0]. For example, when the adder 219$C_1$-1*e* receives sdata=000000 and p_pos[4:0]=10000, the adder 219$C_1$-1*e* outputs s_pos[6:0]=0010000 (see FIG. 20A). The obtained data s_pos[6:0] indicates a set position in GCLK.

The flip-flop 219$C_1$-1*b* receives rdata in synchronization with GCLK, and outputs g_rdata. An adder 219$C_1$-1*f* adds g_rdata to p_pos[4:0], and outputs r_pos[6:0]. For example, when the adder 219$C_1$-1*f* receive rdata=011000 and p_pos[4:0]=10000, the adder 219$C_1$-1*f* outputs r_pos[6:0]=0101000 (see FIG. 20B). The obtained data r_pos[6:0] indicates a reset position in GCLK.

The flip-flop 219$C_1$-1*c* receives svalid from the pixel-data converting circuit 219B in synchronization with GCLK, and outputs g_svalid.

The flip-flop 219$C_1$-1*d* receives rvalid from the pixel-data converting circuit 219B in synchronization with GCLK, and outputs g_rvalid.

Output of the flip-flop 219$C_1$-1*c* is alternately allocated to one of g_svalid1 and g_svalid2 by an allocation circuit 219$C_1$-1*g* (see FIG. 21).

Similarly, output of the flip-flop 219$C_1$-1*d* is alternately allocated to one of g_rvalid1 and g_rvalid2 by an allocation circuit 219$C_1$-1*h*.

Why g_svalid is alternately allocated to g_svalid1 and g_svalid2 will be described by referring to FIG. 22. FIG. 22 is a timing chart of PCLK, GCLK, and virtual edge positions of a PM signal. In this example, each of a first clock period and a second clock period, which are consecutive two clock periods of PCLK, has set and reset. Because the set position in the first clock period is close to the set position in the second clock period, these set positions can fall into a single clock period of GCLK. In a condition where these set positions are in one clock period of GCLK, if the data calculating circuit 219$C_1$-1 outputs, for example, g_svalid, operations subsequent to this step will be performed without data pertaining to the set position in the second clock period. To this end, g_svalid is allocated to g_svalid1 and g_svalid2. Allocation of g_rvalid is performed for a similar reason.

Figure 23:
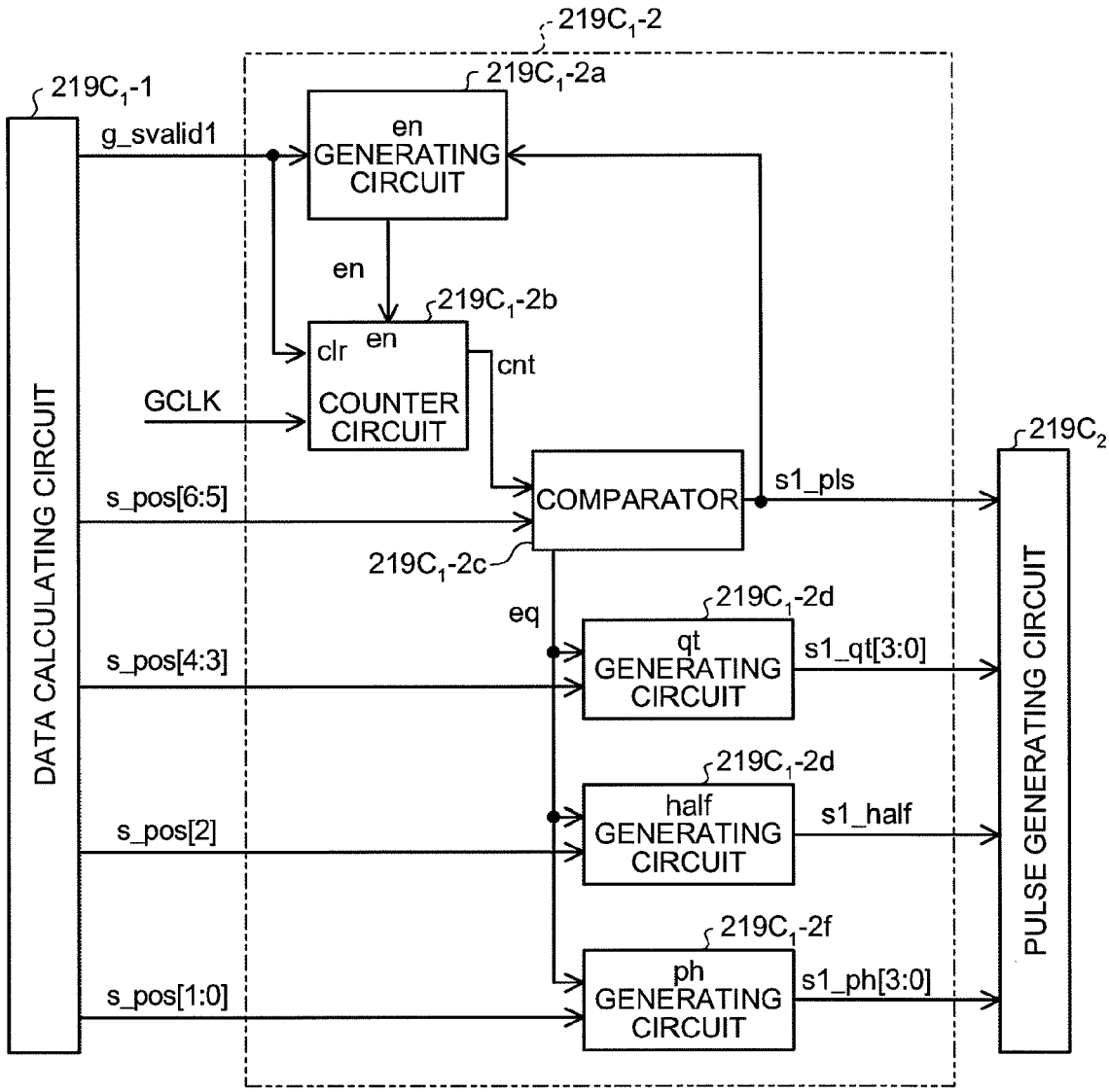
FIG. 23 is a schematic diagram of a first set-phase-data generating circuit shown in FIG. 17.

As shown in FIG. 23, GCLK, g_svalid1, and s_pos[6:0] are fed to the first set-phase-data generating circuit 219$C_1$-2. On receiving these signals, the first set-phase-data generating circuit 219$C_1$-2 generates the first set-phase data. The signals s1_qt3 to s1_qt0 (hereinafter, collectively "s1_qt[3:0]") correspond to QT, s1_half corresponds to HALF, and s1_ph3 to s1_ph0 (hereinafter, collectively "s1_ph[3:0]") correspond to PH. QT, HALF, and PH have already been described.

The first set-phase-data generating circuit 219$C_1$-2 includes an en generating circuit 219$C_1$-2*a*, a counter circuit 219$C_1$-2*b*, a comparator 219$C_1$-2*c*, a qt generating circuit 219$C_1$-2*d*, a half generating circuit 219$C_1$-2*e*, and a ph generating circuit 219$C_1$-2*f*.

The en generating circuit 219$C_1$-2*a* receives g_svalid1 and s1_pls, which is output from the comparator 219$C_1$-2*c*, and outputs a signal en.

The counter circuit 219$C_1$-2*b* receives g_svalid1 and the signal en to count GCLK, and outputs a signal cnt. The counter circuit 219$C_1$-2*b* receives g_svalid1 at its terminal clr.

The comparator 219$C_1$-2*c* receives the signal cnt from the counter circuit 219$C_1$-2*b* and s_pos[6:5] from the data calculating circuit 219$C_1$-1 to compare these signals, and outputs a signal eq. When the comparator 219$C_1$-2*c* determines that values of these signals are equal to each other, the comparator 219$C_1$-2*c* sets the signal eq and s1_pls to high. While the signal eq is toggled high immediately after these values are determined to be equal to each other, s1_pls is toggled high in synchronization with GCLK.

The qt generating circuit 219$C_1$-2*d* receives the signal eq and s_pos[4:3], and outputs s1_qt[3:0].

The qt generating circuit 219$C_1$-2*d* holds one of s1_qt0 to s1_qt3 high depending on s_pos[4:3] for two clock periods of GCLK.

More specifically, on receiving s_pos[4:3]=00, the qt generating circuit 219$C_1$-2*d* sets s1_qt0 to high. On receiving s_pos[4:3]=01, the qt generating circuit 219$C_1$-2*d* sets s1_qt1 to high. On receiving s_pos[4:3]=10, the qt generating circuit 219$C_1$-2*d* sets s1_qt2 to high. On receiving s_pos[4:3]=11, the qt generating circuit 219$C_1$-2*d* sets s1_qt3 to high.

The half generating circuit 219$C_1$-2*e* receives the signal eq and s_pos[2], and outputs s1_half. On receiving s_pos[2]=1, the half generating circuit 219$C_1$-2*e* sets and holds s1_half high for two clock periods of GCLK. On receiving s_pos[2]=0, the half generating circuit 219$C_1$-2*e* causes s1_half to remain low.

The ph generating circuit 219$C_1$-2*f* receives the signal eq and s_pos[1:0], and outputs s1_ph[3:0].

The ph generating circuit 219$C_1$-2*f* holds one of s1_ph0 to s1_ph3 high depending on s_pos[1:0] for two clock periods of GCLK.

More specifically, on receiving s_pos[1:0]=00, the ph generating circuit 219$C_1$-2*f* sets s1_ph0 to high. On receiving s_pos[4:3]=01, the ph generating circuit 219$C_1$-2*f* sets s1_ph1 to high. On receiving s_pos[4:3]=10, the ph generating circuit 219$C_1$-2*f* sets s1_ph2 to high. On receiving s_pos[4:3]=11, the ph generating circuit 219$C_1$-2*f* sets s1_ph3 to high.

In short, on receiving g_svalid1, the first set-phase-data generating circuit 219$C_1$-2 outputs s1_pls, s1_qt[3:0], s1_half, and s1_pf[3:0] that vary depending on s_pos[6:0].

Figure 24:
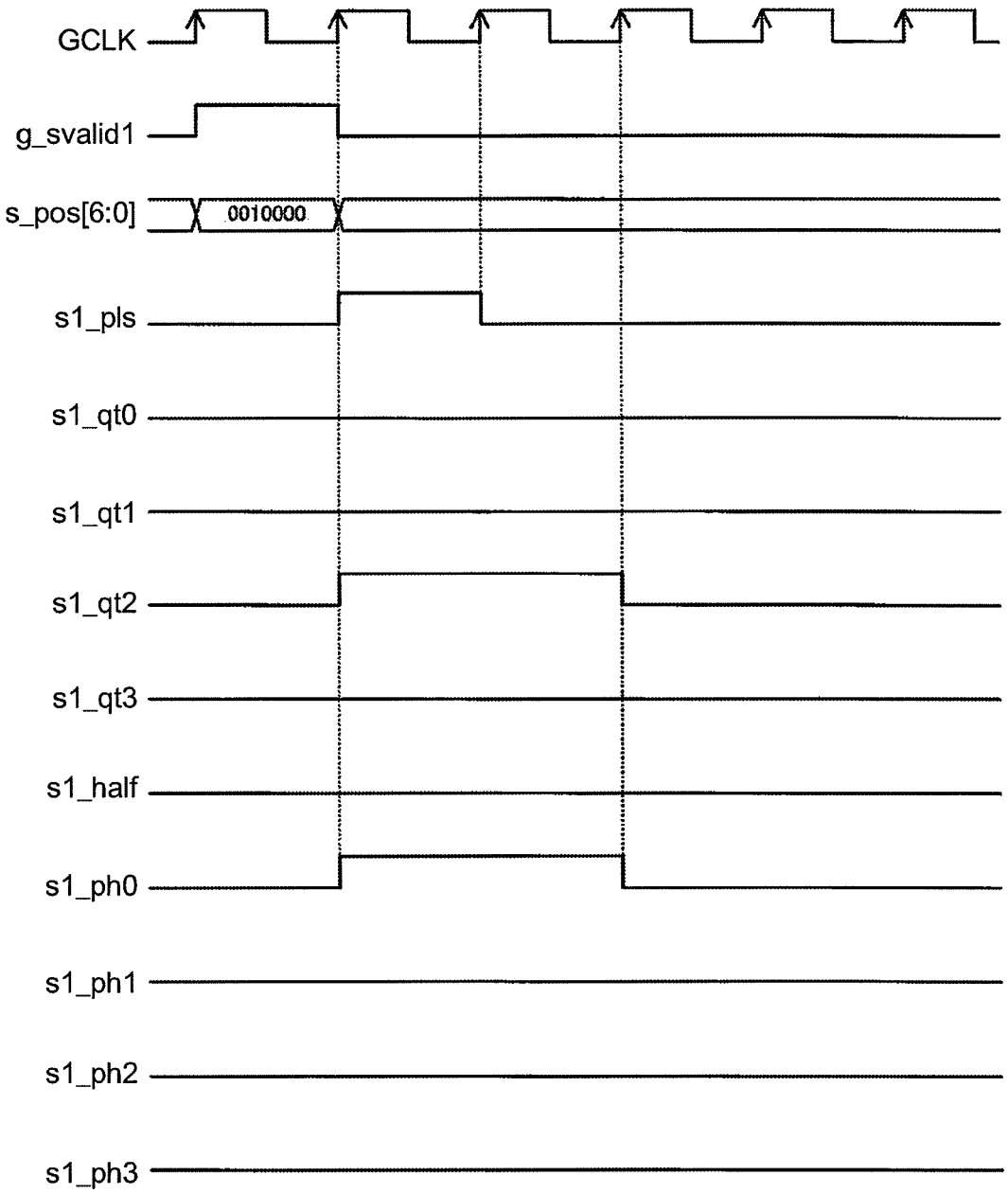
FIG. 24 is a timing chart for explaining how the first set-phase-data generating circuit shown in FIG. 23 operates.

FIG. 24 is a timing chart for explaining how the first set-phase-data generating circuit 219$C_1$-2 operates on receiving s_pos[6:0]=0010000. In this example, according to s_pos[6:5]=00, s1_pls is toggled high immediately after g_svalid1 toggles low. According to s_pos[4:3]=10, s1_qt2 is toggled high. According to s_pos[2]=0, s1_half remains low. According to s_pos[1:0]=00, s1_ph0 is toggled high.

Figure 25:
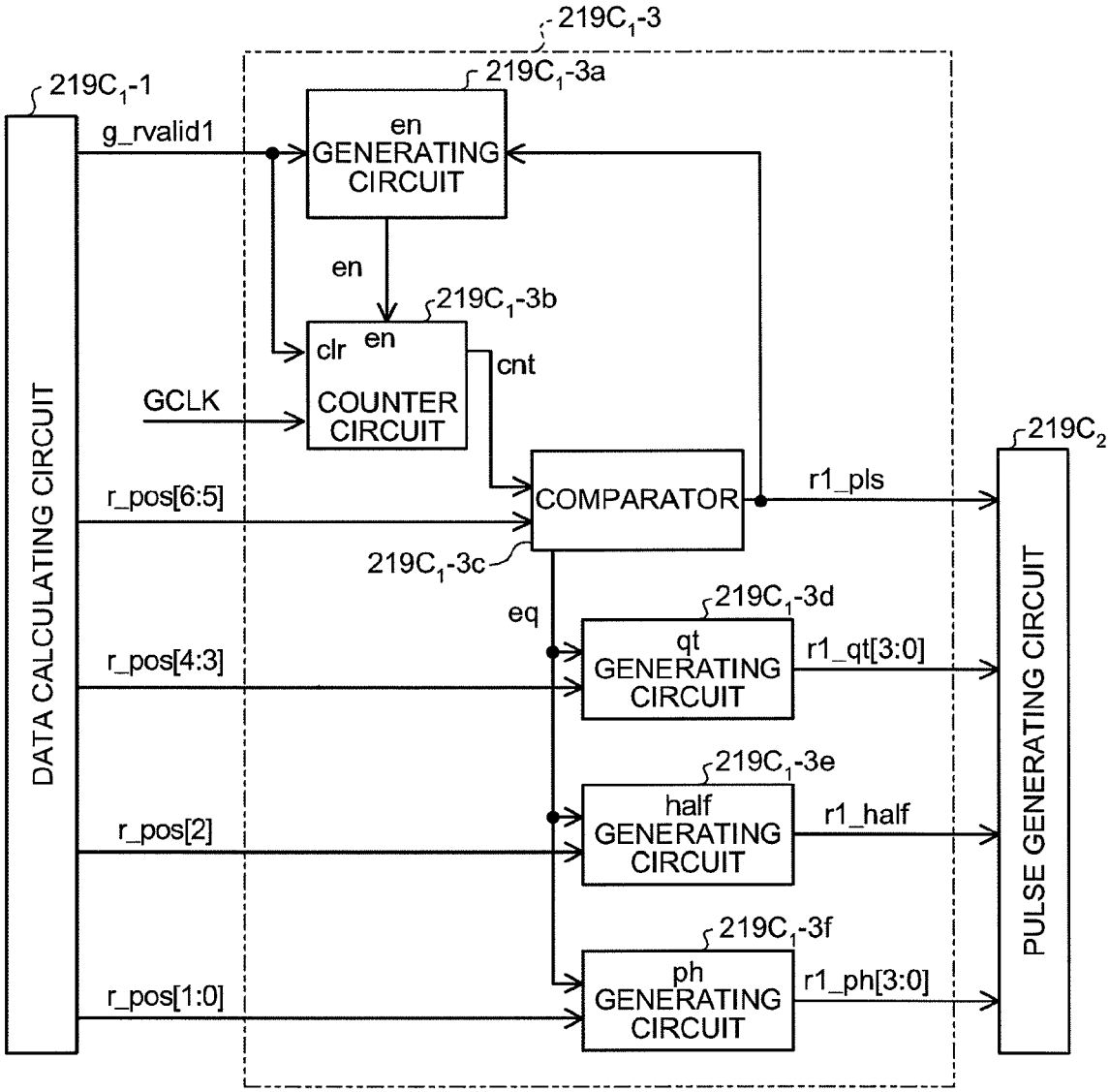
FIG. 25 is a schematic diagram of a first reset-phase-data generating circuit shown in FIG. 17.

As shown in FIG. 25, the first reset-phase-data generating circuit 219$C_1$-3 receives GCLK, g_rvalid1, and r_pos[6:0], and outputs the first reset-phase data.

The first reset-phase-data generating circuit 219$C_1$-3 includes an en generating circuit 219$C_1$-3*a*, a counter circuit 219$C_1$-3*b*, a comparator 219$C_1$-3*c*, a qt generating circuit 219$C_1$-3*d*, a half generating circuit 219$C_1$-3*e*, and a ph generating circuit 219$C_1$-3*f*.

The en generating circuit 219$C_1$-3*a* receives g_rvalid1 and an r1_pls, which is output from the comparator 219$C_1$-3*c*, and outputs a signal en.

The counter circuit 219$C_1$-3*b* receives g_rvalid1 and the signal en to count GCLK, and outputs a signal cnt.

The comparator 219$C_1$-3*c* receives the signal cnt from the counter circuit 219$C_1$-3*b* and r_pos[6:5] from the data calculating circuit 219$C_1$-1 to compares values of these signals, and outputs a signal eq. When the comparator 219$C_1$-3*c* determines that these values are equal to each other, the comparator 219$C_1$-3*c* sets the signal eq and r1_pls to high. While the signal eq is toggled high immediately after these values are determined to be equal to each other, r1_pls is toggled high in synchronization with GCLK.

The qt generating circuit 219$C_1$-3*d* receives the signal eq and r_pos[4:3], and outputs r1_qt[3:0].

The qt generating circuit 219$C_1$-3*d* holds one of r1_qt0 to r1_qt3 high depending on r_pos[4:3] for two clock periods of GCLK.

More specifically, on receiving r_pos[4:3]=00, the qt generating circuit 219$C_1$-3*d* sets r1_qt0 to high. On receiving r_pos[4:3]=01, the qt generating circuit 219$C_1$-3*d* sets r1_qt1 to high. On receiving r_pos[4:3]=10, the qt generating circuit 219$C_1$-3*d* sets r1_qt2 to high. On receiving r_pos[4:3]=11, the qt generating circuit 219$C_1$-3*d* sets r1_qt3 to high.

The half generating circuit 219$C_1$-3*e* receives the signal eq and r_pos[2], and outputs r1_half. On receiving r_pos[2]=1, the half generating circuit 219$C_1$-3*e* holds r1_half high for two clock periods of GCLK. On receiving r_pos[2]=0, the half generating circuit 219$C_1$-3*e* causes r1_half to remain low.

The ph generating circuit 219$C_1$-3*f* receives the signal eq and r_pos[1:0], and outputs r1_ph[3:0].

The ph generating circuit 219$C_1$-3*f* holds one of r1_ph0 to r1_ph3 high depending on r_pos[1:0] for two clock periods of GCLK.

More specifically, on receiving r_pos[1:0]=00, the ph generating circuit 219$C_1$-3*f* sets r1_ph0 to high. On receiving r_pos[4:3]=01, the ph generating circuit 219$C_1$-3*f* sets r1_ph1 to high. On receiving r_pos[4:3]=10, the ph generating circuit 219$C_1$-3*f* sets r1_ph2 to high. On receiving r_pos[4:3]=11, the ph generating circuit 219$C_1$-3*f* sets r1_ph3 to high.

In short, on receiving g_rvalid1, the first reset-phase-data generating circuit 219$C_1$-3 outputs r1_pls, r1_qt[3:0], r1_half, and r1_pf[3:0] that vary depending on r_pos[6:0].

Figure 26:
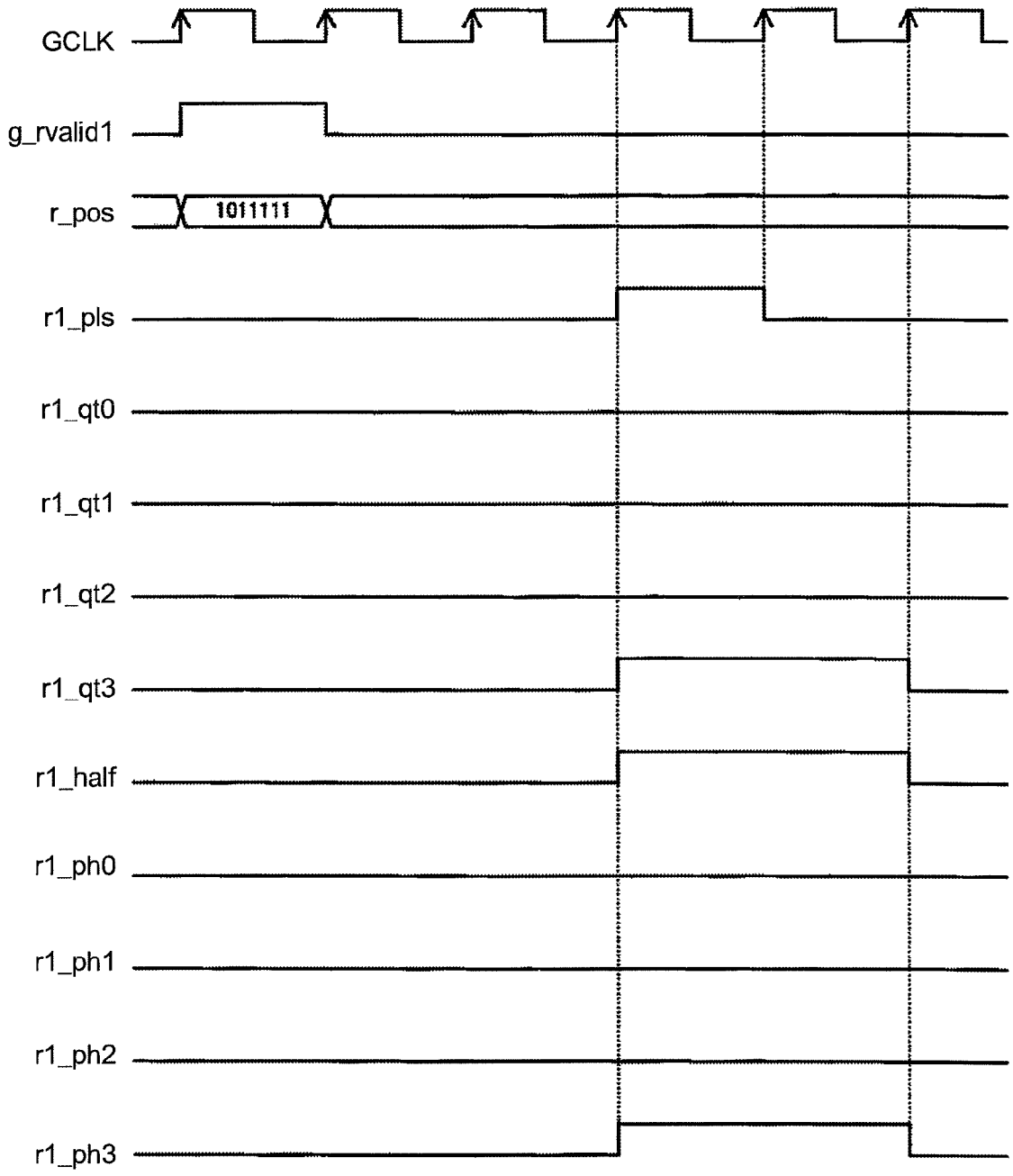
FIG. 26 is a timing chart for explaining how the first reset-phase-data generating circuit shown in FIG. 25 operates.

FIG. 26 is a timing chart for explaining how the first reset-phase-data generating circuit 219$C_1$-3 operates on receiving r_pos[6:0]=1011111. In this example, according to r_pos[6:

5]=10, r1_pls is toggled high after a delay of two clock periods of GCLK relative to s1_pls in the timing chart of FIG. 24. According to r_pos[4:3]=11, r1_qt3 is toggled high. According to r_pos[2]=1, r1_half is toggled high. According to r_pos[1:0]=11, r1_ph3 is toggled high.

The second set-phase-data generating circuit 219$C_1$-4 receives GCLK, g_svalid2, and s_pos[6:0]. On receiving these signals, the second set-phase-data generating circuit 219$C_1$-4 generates the second set-phase data. The second set-phase-data generating circuit 219$C_1$-4 can have a similar structure to that of the first set-phase-data generating circuit 219$C_1$-2.

The second reset-phase-data generating circuit 219$C_1$-5 receives GCLK, g_rvalid 2, and r_pos[6:0]. On receiving these signals, the second reset-phase-data generating circuit 219$C_1$-5 generates the second reset-phase data. The second reset-phase-data generating circuit 219$C_1$-5 can have a similar structure to that of the first reset-phase-data generating circuit 219$C_1$-3.

The first set-phase-data generating circuit 219$C_1$-2 and the first reset-phase-data generating circuit 219$C_1$-3 are operated in a toggling manner (alternately); and the second set-phase-data generating circuit 219$C_1$-4 and the second reset-phase-data generating circuit 219$C_1$-5 are operated in a toggling manner.

Figure 27:
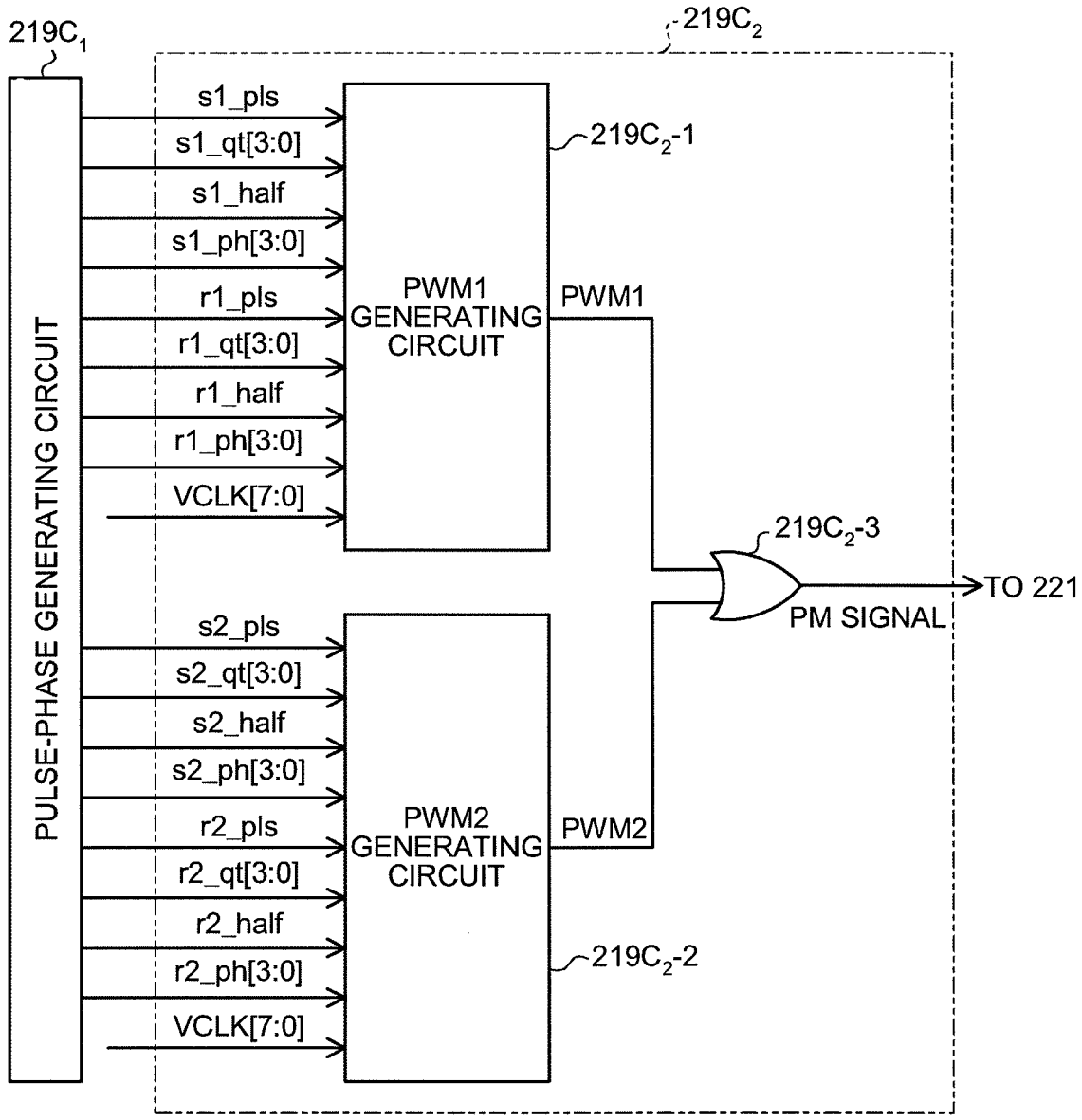
FIG. 27 is a schematic diagram of a pulse generating circuit shown in FIG. 17.

As shown in FIG. 27, the pulse generating circuit 219$C_2$ receives GCLK, VCLK[7:0], and the phase data (the first set-phase data, the second set-phase data, the first reset-phase data, and the second reset-phase data), and outputs a PM signal.

The pulse generating circuit 219$C_2$ includes a PWM1 generating circuit 219$C_2$-1, a PWM2 generating circuit 219$C_2$-2, and an OR circuit 219$C_2$-3.

Figure 28:
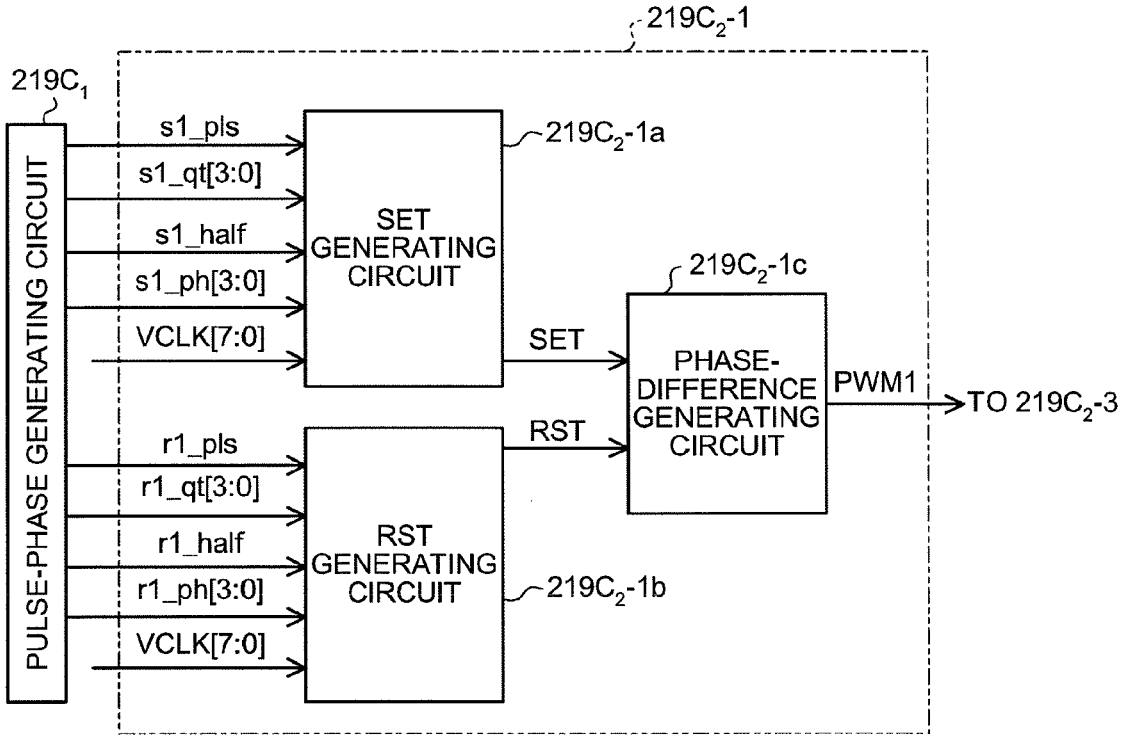
FIG. 28 is a schematic diagram of a PWM1 generating circuit shown in FIG. 27.

As shown in FIG. 28, the PWM1 generating circuit 219$C_2$-1 receives VCLK[7:0], the first set-phase data, and the first reset-phase data, and outputs a signal PWM1.

The PWM1 generating circuit 219$C_2$-1 includes a SET generating circuit 219$C_2$-1*a*, an RST generating circuit 219$C_2$-1*b*, and a phase-difference generating circuit 219$C_2$-1*c*.

Figure 29:
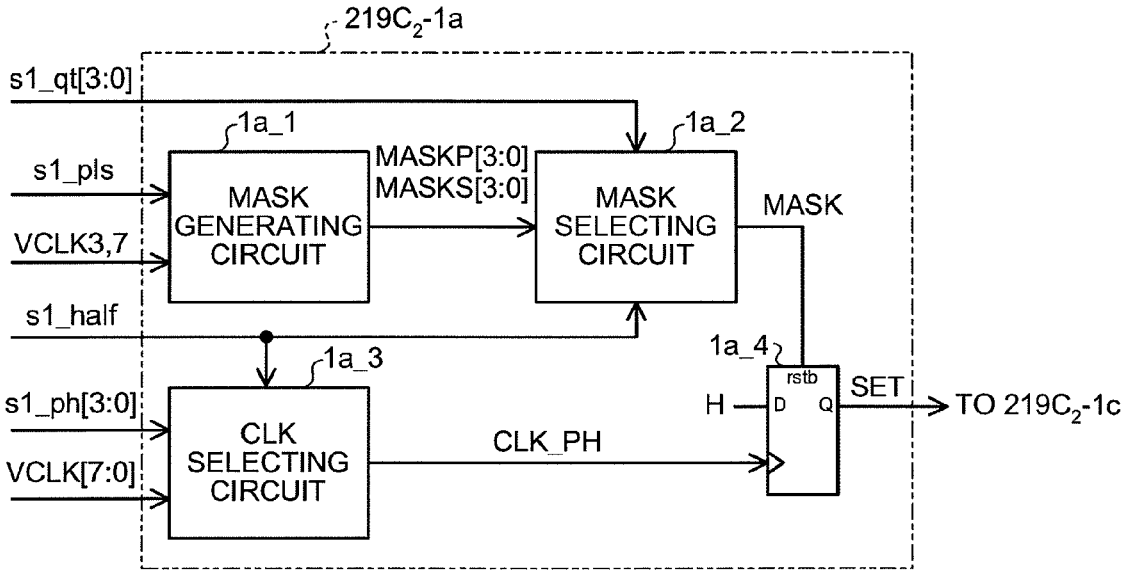
FIG. 29 is a schematic diagram of a SET generating circuit shown in FIG. 28.

As shown in FIG. 29, the SET generating circuit 219$C_2$-1*a* receives VCLK[7:0] and the first set-phase data, and outputs a signal SET. A rising edge of the signal SET indicates a position of a rising edge of a signal PWM1.

The SET generating circuit 219$C_2$-1*a* includes a MASK generating circuit 1*a*_1, a MASK selecting circuit 1*a*_2, a CLK selecting circuit 1*a*_3, and a flip-flop 1*a*_4.

Figure 30:
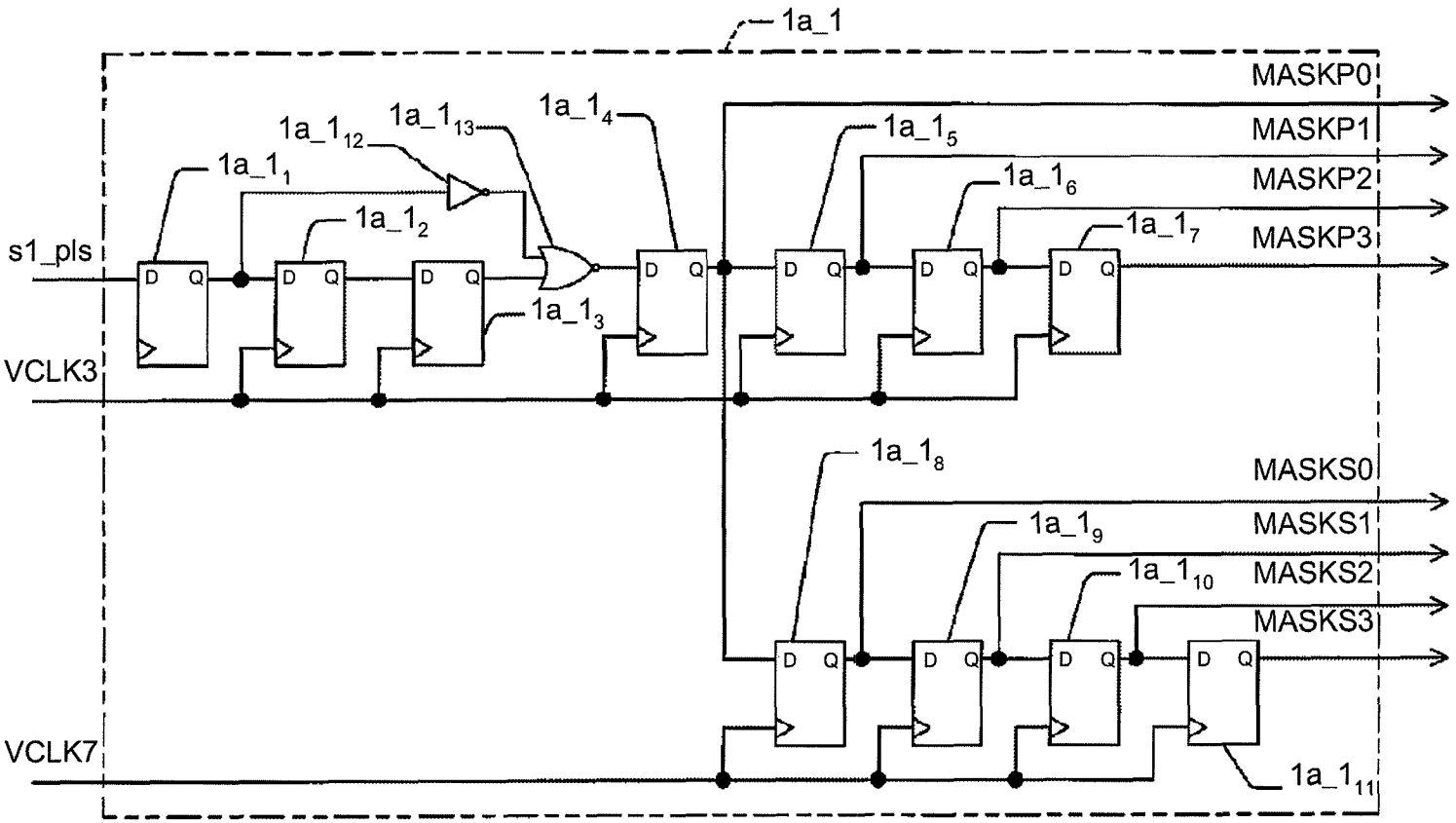
FIG. 30 is a schematic diagram of a MASK generating circuit shown in FIG. 29.

As shown in FIG. 30, the MASK generating circuit 1*a*_1 receives s1_pls, VCLK3, and VCLK7, and outputs MASKP3 to MASKP0 (hereinafter, collectively "MASKP[3:0]") and MASKS3 to MASKS0 (hereinafter, collectively "MASKS[3:0]").

The MASK generating circuit 1*a*_1 includes 11 flip-flops (1*a*_$\mathbf{1}_1$ to 1*a*_$\mathbf{1}_{11}$), an inverting (INV) circuit 1*a*_$\mathbf{1}_{12}$, and a NOR circuit 1*a*_$\mathbf{1}_{13}$.

On detecting a rising edge of s1_pls, the MASK generating circuit 1*a*_1 sequentially outputs MASKP[3:0] in synchronization with VLCK3, as well as sequentially outputs MASKS[3:0] in synchronization with VLCK7. The MASK generating circuit 1*a*_1 outputs MASKP[3:0] and MASKS[3:0] such that each of MASKP[3:0] and MASKS[3:0] is held high for two clock periods of VCLK. A phase difference between consecutive two signals of MASKP[3:0] and MASKS[3:0] is a single clock period of VCLK (see FIG. 31).

Figure 31:
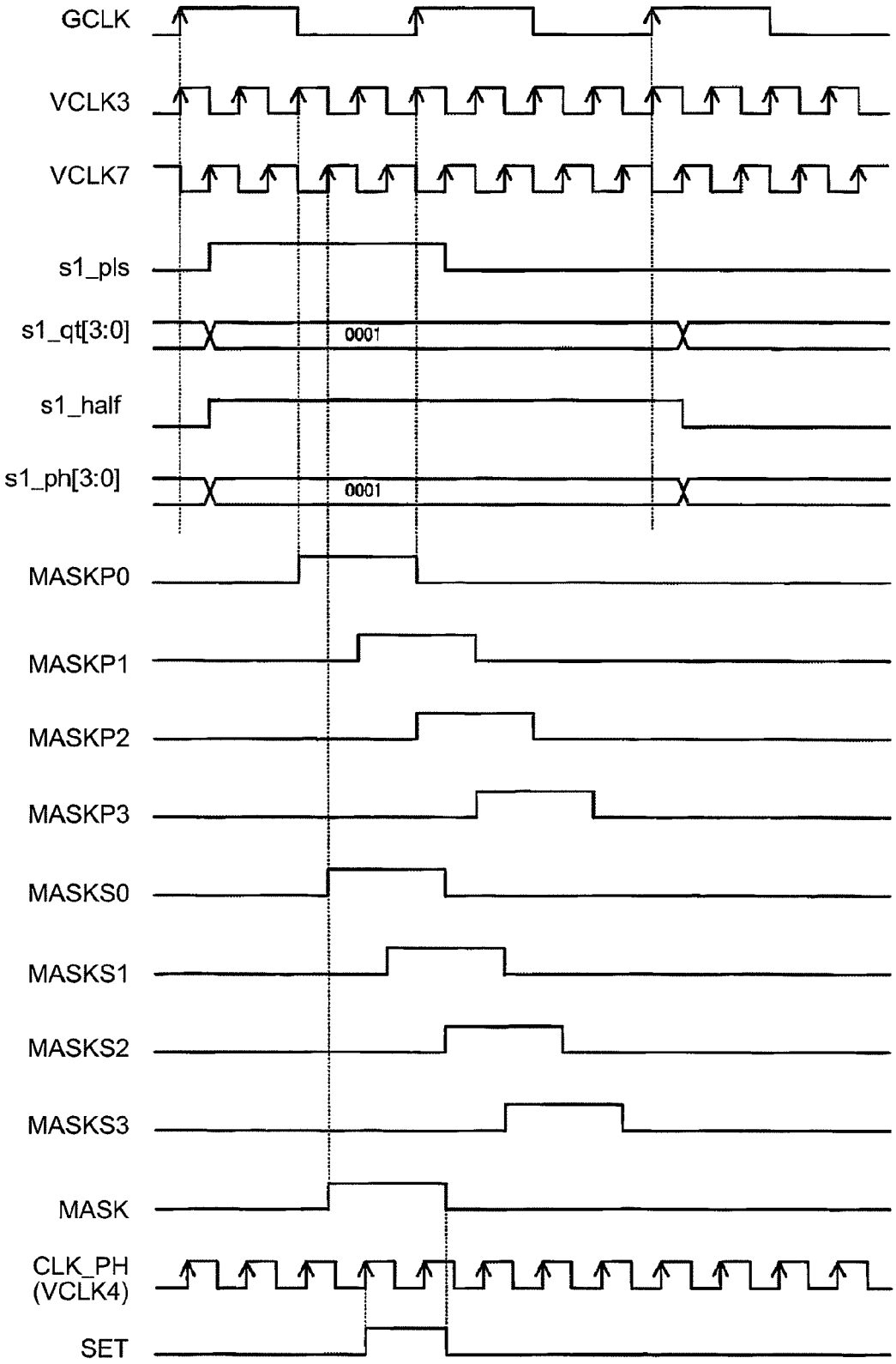
FIG. 31 is a timing chart for explaining how the SET generating circuit shown in FIG. 29 operates.

FIG. 31 is an example of a timing chart for explaining how the MASK generating circuit 1*a*_1 operates. On receiving s1_pls at an edge of one clock period of VCLK3, the MASK generating circuit 1*a*_1 outputs MASKP0 at an edge of a subsequent clock period of VCLK3. A phase difference between MASKP0 and MASKS0 is equal to the phase difference between VCLK3 and VCLK7, that is, a half clock cycle time of VCLK.

Figure 32:
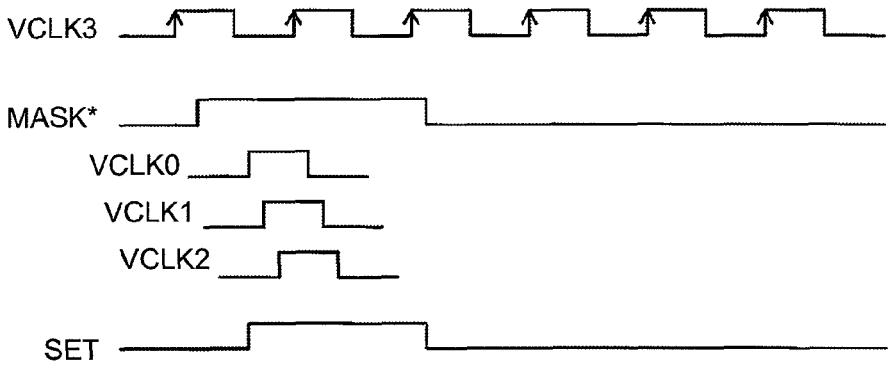
FIG. 32 is a timing chart for explaining why the MASK generating circuit shown in FIG. 29 generates a signal MASK based on VCLK3.

In this example, VCLK[7:0] are divided into VCLK[3:0] and VCLK[7:4] depending on s1_half. To mask VCLK accurately and generate a signal SET for an accurate position, it is preferable to take analog delay caused by generation of a signal MASK into consideration. More specifically, it is preferable to generate MASKP[3:0] based on VCLK3 (see FIG. 32), and MASKS[3:0] based on VCLK7.

Figure 33:
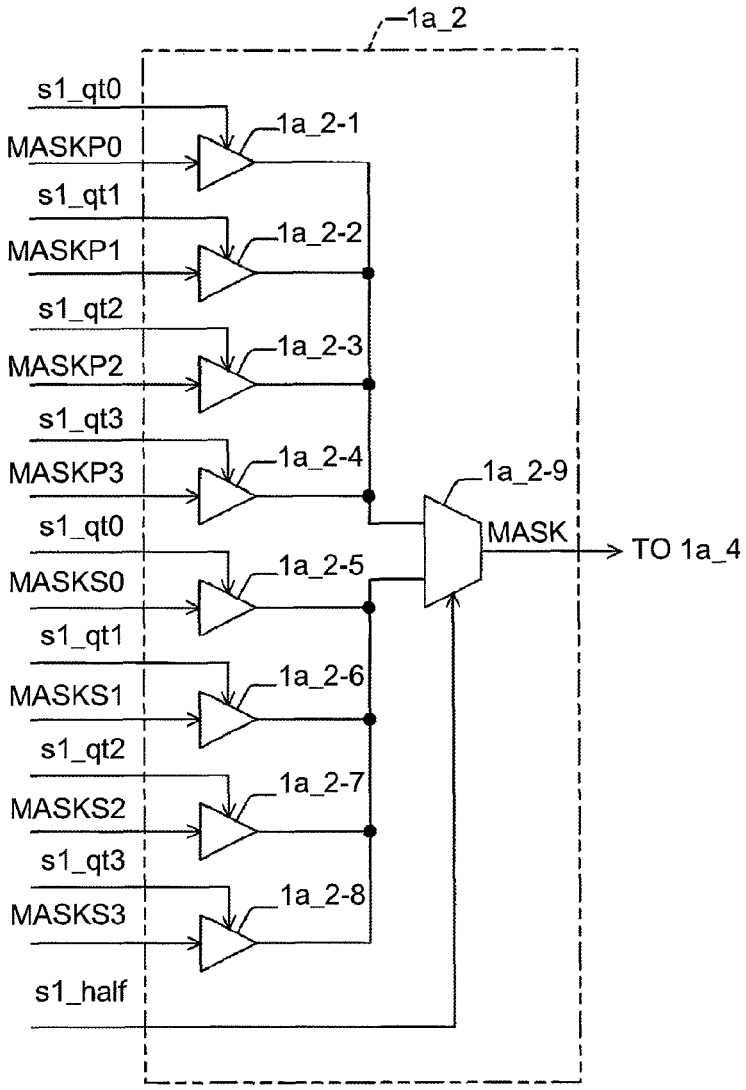
FIG. 33 is a schematic diagram of a MASK selecting circuit shown in FIG. 29.

As shown in FIG. 33, the MASK selecting circuit 1*a*_2 receives MASKP[3:0], MASKS[3:0], s1_half, and s1_qt[3:0], and outputs a signal MASK.

The MASK selecting circuit 1*a*_2 includes eight gated buffers (1*a*_2-1 to 1*a*_2-8) and a multiplexer 1*a*_2-9.

The gated buffer 1*a*_2-1 receives MASKP0 and s1_qt0. When s1_qt0 is at high level, the gated buffer 1*a*_2-1 is enabled as a buffer. When s1_qt0 is not at high level, output of the gated buffer 1*a*_2-1 is placed in high-impedance Z state.

The gated buffer 1*a*_2-2 receives MASKP1 and s1_qt1. When s1_qt1 is at high level, the gated buffer 1*a*_2-2 is enabled as a buffer. When s1_qt1 is not at high level, output of the gated buffer 1*a*_2-2 is placed in high-impedance Z state.

The gated buffer 1*a*_2-3 receives MASKP2 and s1_qt2. When s1_qt2 is at high level, the gated buffer 1*a*_2-3 is enabled as a buffer. When s1_qt2 is not at high level, output of the gated buffer 1*a*_2-3 is placed in high-impedance Z state.

The gated buffer 1*a*_2-4 receives MASKP3 and s1_qt3. When s1_qt3 is at high level, the gated buffer 1*a*_2-4 is enabled as a buffer. When s1_qt3 is not at high level, output of the gated buffer 1*a*_2-4 is placed in high-impedance Z state.

An output of each of the gated buffers 1*a*_2-1 to 1*a*_2-4 is fed to one of input terminals of the multiplexer 1*a*_2-9 as a first input signal.

The gated buffer 1*a*_2-5 receives MASKS0 and s1_qt0. When s1_qt0 is at high level, the gated buffer 1*a*_2-5 is enabled as a buffer. When s1_qt0 is not at high level, output of the gated buffer 1*a*_2-5 is placed in high-impedance Z state.

The gated buffer 1*a*_2-6 receives MASKS1 and s1_qt1. When s1_qt1 is at high-level, the gated buffer 1*a*_2-6 is enabled as a buffer. When s1_qt1 is not at high level, output of the gated buffer 1*a*_2-6 is placed in high-impedance Z state.

The gated buffer 1*a*_2-7 receives MASKS2 and s1_qt2. When s1_qt2 is at high level, the gated buffer 1*a*_2-7 is enabled as a buffer. When s1_qt2 is not at high level, output of the gated buffer 1*a*_2-8 is placed in high-impedance Z state.

The gated buffer 1*a*_2-8 receives MASKS3 and s1_qt3. When s1_qt3 is at high level, the gated buffer 1*a*_2-8 is enabled as a buffer. When s1_qt3 is not at high level, output of the gated buffer 1*a*_2-8 is placed in high-impedance Z state.

An output of each of the gated buffers 1*a*_2-5 to 1*a*_2-8 is fed to the other of the input terminals of the multiplexer 1*a*_2-9 as a second input signal.

The multiplexer 1*a*_2-9 selects one of the first input signal and the second input signal according to s1_half, and outputs the selected signal as a signal MASK.

The MASK selecting circuit 1*a*_2 selects one of MASKS[3:0] and MASKP[3:0] according to s1_qt[3:0] and s1_half, and outputs the selected signal as the signal MASK.

For example, on receiving s1_qt[3:0]=0001 and s1_half=1, the MASK selecting circuit 1*a*_2 selects MASKS0 as the signal MASK (see FIG. 31).

Figure 34:
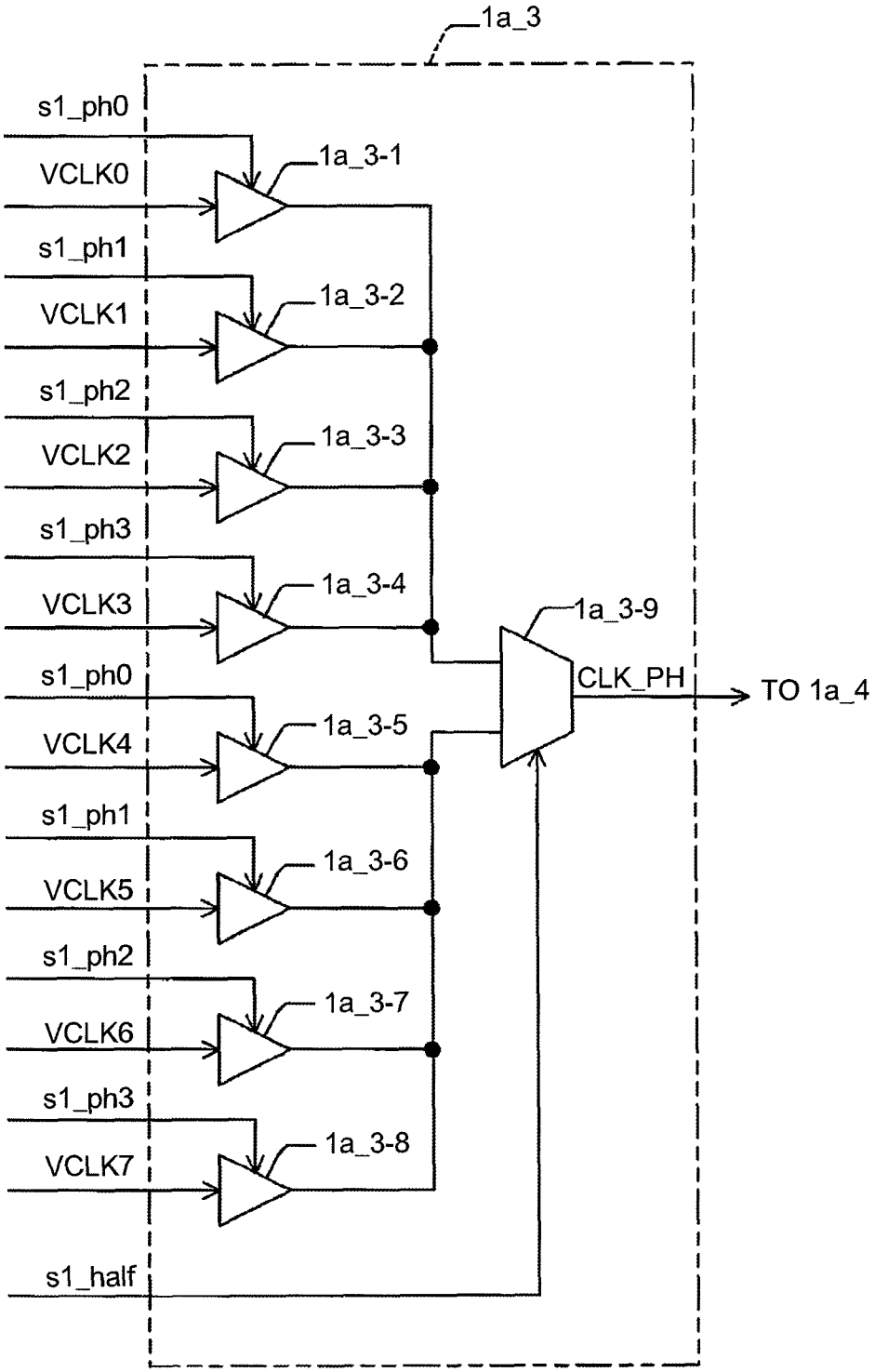
FIG. 34 is a schematic diagram of a CLK selecting circuit shown in FIG. 29.
Figure 35:
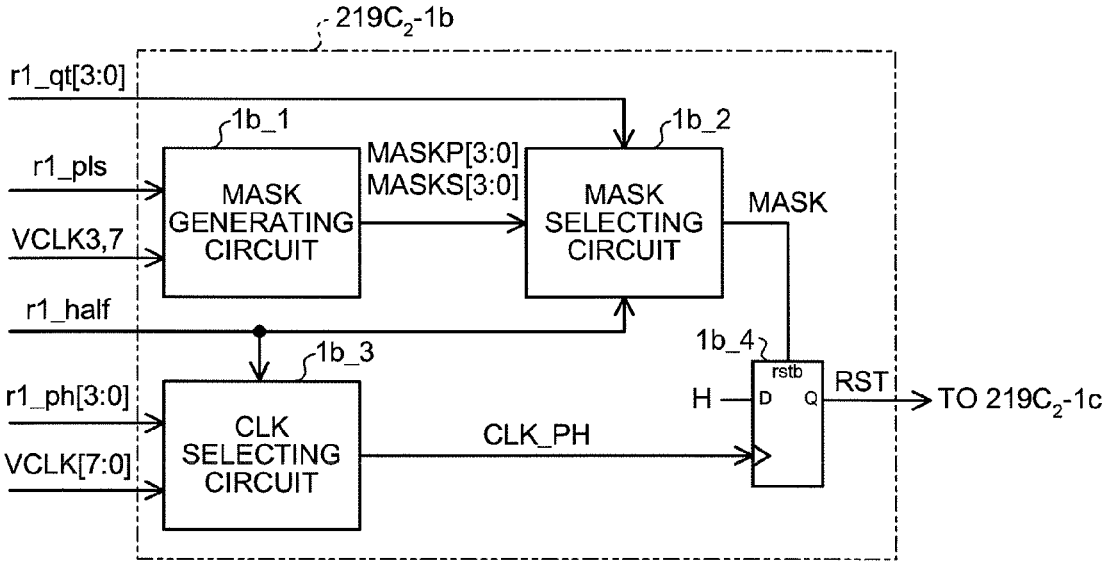
FIG. 35 is a schematic diagram of an RST generating circuit shown in FIG. 28.

As shown in FIG. 34, the CLK selecting circuit 1*a*_3 receives VCLK[7:0], s1_half, and s1_ph[3:0], and outputs CLK_PH.

The CLK selecting circuit 1a_3 includes eight gated buffers (1a_3-1 to 1a_3-8) and a multiplexer 1a_3-9.

The gated buffer 1a_3-1 receives VCLK0 and s1_ph0. When s1_ph0 is at high level, the gated buffer 1a_3-1 is enabled as a buffer. When s1_ph0 is not at high level, output of the gated buffer 1a_3-1 is placed in high-impedance Z state.

The gated buffer 1a_3-2 receives VCLK1 and s1_ph1. When s1_ph1 is at high level, the gated buffer 1a_3-2 is enabled as a buffer. When $s1_{ph}1$ is not at high level, output of the gated buffer 1a_3-2 is placed in high-impedance Z state.

The gated buffer 1a_3-3 receives VCLK2 and s1_ph2. When s1_ph2 is at high level, the gated buffer 1a_3-3 is enabled as a buffer. When s1_ph2 is not at high level, output of the gated buffer 1a_3-3 is placed in high-impedance Z state.

The gated buffer 1a_3-4 receives VCLK3 and s1_ph3. When s1_ph3 is at high level, the gated buffer 1a_3-4 is enabled as a buffer. When s1_ph3 is not at high level, output of the gated buffer 1a_3-4 is placed in high-impedance Z state.

An output of each of the gated buffers 1a_3-1 to 1a_3-4 is fed to one of input terminals of the multiplexer 1a_3-9 as a third input signal.

The gated buffer 1a_3-5 receives VCLK4 and s1_ph0. When s1_ph0 is at high level, the gated buffer 1a_3-5 is enabled as a buffer. When s1_ph0 is not at high level, output of the gated buffer 1a_3-5 is placed in high-impedance Z state.

The gated buffer 1a_3-6 receives VCLK5 and s1_ph1. When s1_ph1 is at high level, the gated buffer 1a_3-6 is enabled as a buffer. When s1_ph1 is not at high level, output of the gated buffer 1a_3-6 is placed in high-impedance Z state.

The gated buffer 1a_3-7 receives VCLK6 and s1_ph2. When s1_ph2 is at high level, the gated buffer 1a_3-7 is enabled as a buffer. When s1_ph2 is not at high level, output of the gated buffer 1a_3-7 is placed in high-impedance Z state.

The gated buffer 1a_3-8 receives VCLK7 and s1_ph3. When s1_ph3 is at high level, the gated buffer 1a_3-8 is enabled as a buffer. When s1_ph3 is not at high level, output of the gated buffer 1a_3-8 is placed in high-impedance Z state.

An output of each of the gated buffers 1a_3-5 to 1a_3-8 is fed to the other of the input terminals of the multiplexer 1a_3-9 as a fourth input signal.

The multiplexer 1a_3-9 selects one of the third input signal and the fourth input signal according to s1_half, and outputs the selected signal as a signal CLK_PH.

As described above, the CLK selecting circuit 1a_3 selects one of VCLK[7:0] according to s1_ph[3:0] and s1_half, and outputs the selected signal as CLK_PH.

More specifically, the CLK selecting circuit 1a_3 selects CLK_PH from VCLK[7:0] only when any one of s1_ph[3:0] has a rising edge.

For example, on receiving s1_ph[3:0]=0001 and s1_half=1, the CLK selecting circuit 1a_3 selects VCLK4 as CLK_PH (see FIG. 31).

Accordingly, VCLK is fed to the flip-flop 1a_4 only during a predetermined period in which a PM signal has a rising edge or a falling edge. Hence, according to this technology, power consumption can be reduced as compared with a conventional technology in which high-frequency clock signals are constantly fed to a modulation-signal generating circuit.

Furthermore, because clock signals can be fed to the flip-flop 1a_4 via only one clock-signal data line, power consumption can be further reduced.

As shown in FIG. 29, the flip-flop 1a_4 receives the signal MASK and CLK_PH, and outputs a signal SET. When CLK_PH is toggled high in a state where the signal MASK is at high level, the signal SET is toggled high. When the signal MASK is toggled low, the signal SET is also toggled low (see FIG. 31).

As shown in FIG. 28, the RST generating circuit 219$C_2$-1b receives VCLK[7:0] and the first reset-phase data, and outputs a signal RST. A rising edge of the signal RST indicates a position of a falling edge of a signal PWM1.

The RST generating circuit 219$C_2$-1b includes a MASK generating circuit 1b_1, a MASK selecting circuit 1b_2, a CLK selecting circuit 1b_3, and a flip-flap 1b_4.

The MASK generating circuit 1b_1 has a similar structure to that of the MASK generating circuit 1a_1. The MASK generating circuit 1b_1 receives VCLK3, VCLK7, and r1_pls, and outputs MASKP[3:0] and MASKS[3:0].

On detecting a rising edge of r1_pls, the MASK generating circuit 1b_1 sequentially outputs MASKP[3:0] in synchronization with VLCK3 and sequentially outputs MASKS[3:0] in synchronization with VLCK7. The MASK generating circuit 1b_1 outputs MASKP[3:0] and MASKS[3:0] such that each of MASKP[3:0] and MASKS[3:0] is held high for two clock periods of VCLK. A phase difference between consecutive two signals of MASKP[3:0] and MASKS[3:0] is a single clock period of VLCK (see FIG. 36).

Figure 36:
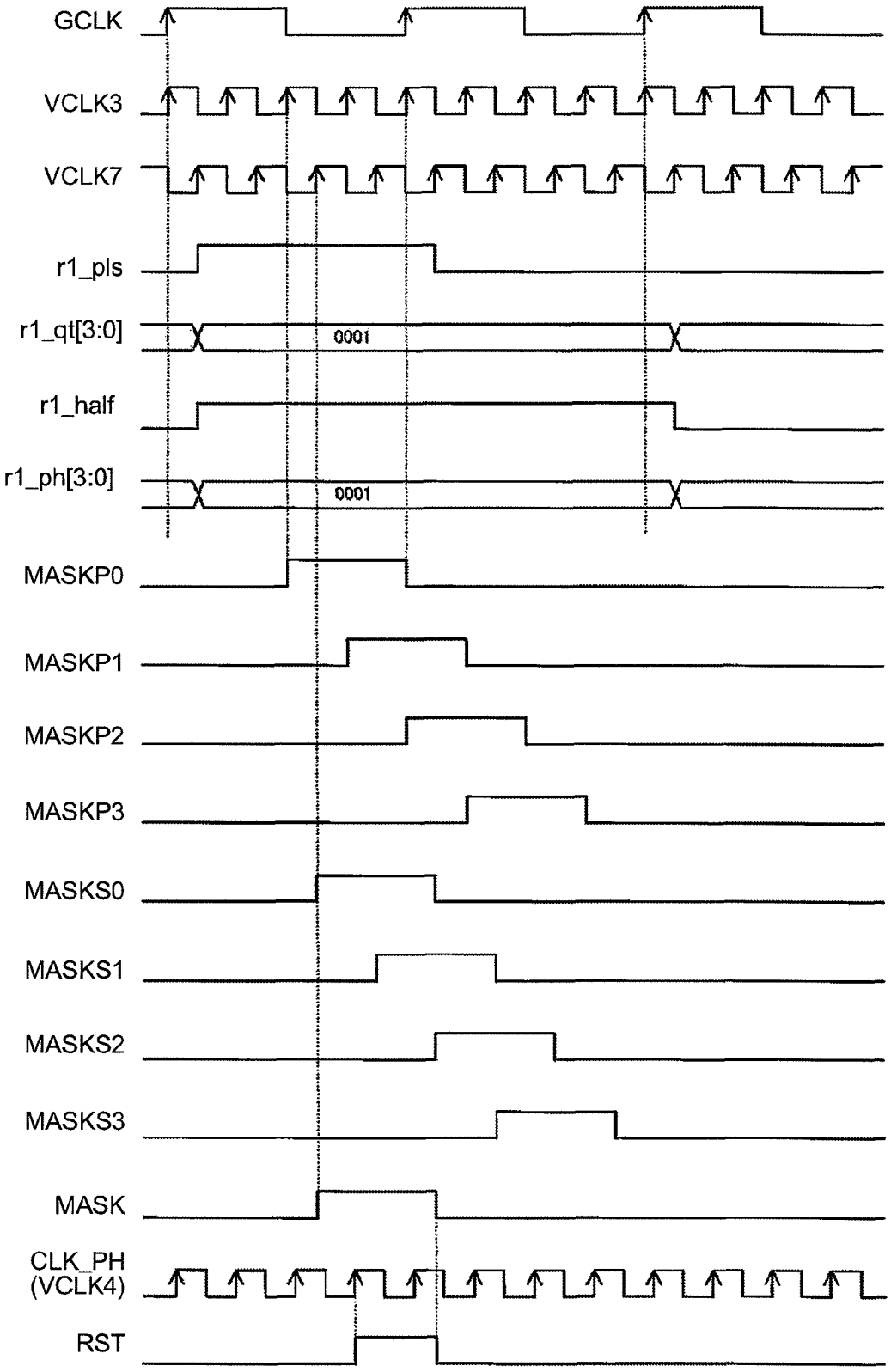
FIG. 36 is a timing chart for explaining how the RST generating circuit shown in FIG. 35 operates.

FIG. 36 is an example of a timing chart for explaining how the MASK generating circuit 1b_1 operates. On receiving r1_pls at an edge of one clock period of VCLK3, the MASK generating circuit 1b_1 outputs MASKP0 at an edge of a subsequent clock period of VCLK3. A phase difference between MASKP0 and MASKS0 is equal to a phase difference between VCLK3 and VCLK7, that is, a half clock cycle time of VCLK.

The MASK selecting circuit 1b_2 has a similar structure to that of the MASK selecting circuit 1a_2. The MASK selecting circuit 1b_2 selects one of MASKS[3:0] and MASKP[3:0] according to r1_qt[3:0] and r1_half, and outputs the selected signal as a signal MASK.

For example, on receiving r1_qt[3:0]=0001 and r1_half=1, the MASK selecting circuit 1b_2 selects MASKS0 as the signal MASK (see FIG. 36).

The CLK selecting circuit 1b_3 has a similar structure to that of the CLK-signal selecting circuit 1a_3. The CLK selecting circuit 1b_3 selects one of VCLK[7:0] according to r1_ph[3:0] and r1_half, and outputs the selected signal as CLK_PH.

More specifically, the CLK selecting circuit 1b_3 selects CLK_PH from VCLK[7:0] only when any one of r1_ph[3:0] has a rising edge.

For example, on receiving r1_ph[3:0]=0001 and r1_half=1, the CLK selecting circuit 1b_3 selects VCLK4 as CLK_PH (see FIG. 36).

Accordingly, VCLK is fed to the flip-flop 1a_4 only during a predetermined period in which a PM signal has a rising edge or a falling edge. Hence, according to this technology, power consumption can be reduced as compared with a conventional technology in which high-frequency clock signals are constantly fed to a modulation-signal generating circuit.

Furthermore, because clock signals can be fed to the flip-flop 1b_4 via only one clock-signal data line, power consumption can be further reduced.

The flip-flop 1b_4 receives the signal MASK and CLK_PH, and outputs a signal RST. When CLK_PH is toggled high in a state where the signal MASK is at high level, the signal RST is toggled high. When the signal MASK is toggled low, the signal RST is also toggled low (see FIG. 36).

Figure 37:
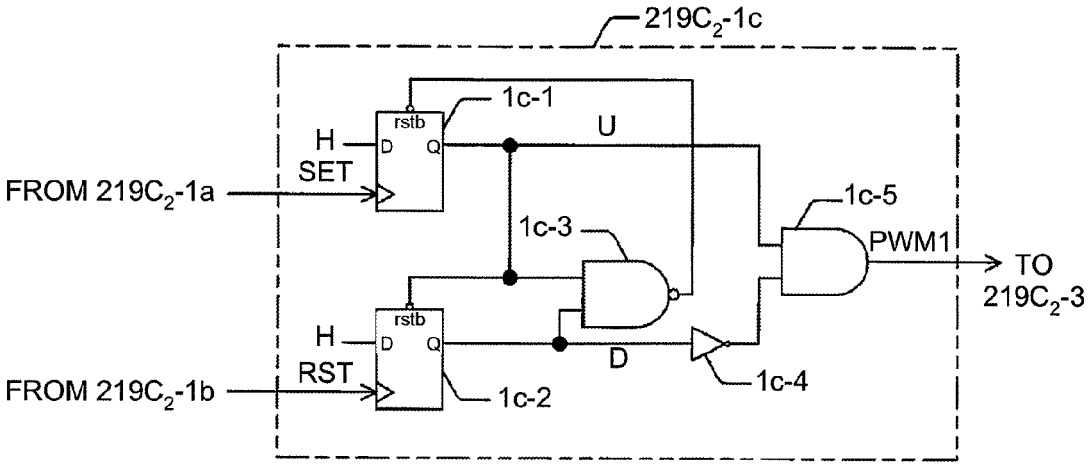
FIG. 37 is a schematic diagram for explaining a phase-difference generation shown in FIG. 28.

As shown in FIG. 37, the phase-difference generating circuit 219$C_2$-1*c* obtains a phase difference between the signal SET and the signal RST, and outputs a signal PWM1.

The phase-difference generating circuit 219$C_2$-1*c* includes two flip-flops (1*c*-1 and 1*c*-2), a NAND circuit 1*c*-3, an inverting circuit 1*c*-4, and an AND circuit 1*c*-5.

Figure 38:
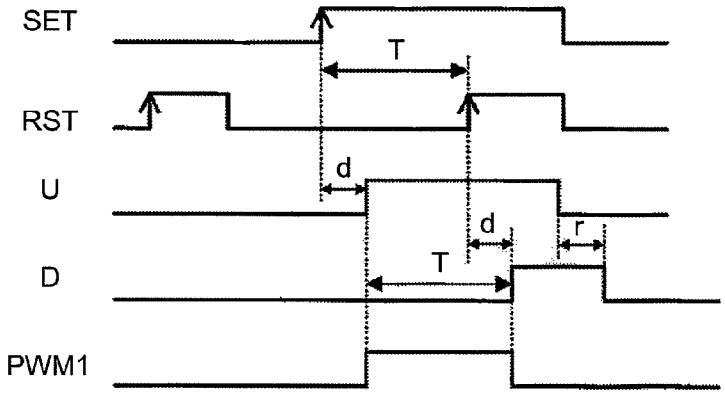
FIG. 38 is a timing chart for explaining how the phase-difference generating circuit shown in FIG. 37 operates.

FIG. 38 is an example of a timing chart for explaining how the phase-difference generating circuit 219$C_2$-1*c* operates. When the signal SET is toggled high, an output signal U of the flip-flop 1*c*-1 is toggled high after an analog delay of d. When the signal RST is toggled high, an output signal D of the flip-flop 1*c*-1 is toggled low after the same analog delay of d. When both the signal U and the signal D are toggled high, an output signal of the NAND circuit 1*c*-3 is toggled low, bringing the signal U to low. Thereafter, the signal D is also toggled low. Hence, by inputting the signal U and the output signal of the NAND circuit 1*c*-3 to the AND circuit 1*c*-5, a signal PWM1 can be obtained. A pulse width of the signal PWM1 is equal to a phase difference T between the signal SET and the signal RST.

The PWM2 generating circuit 219$C_2$-2 receives VCLK[7:0], the second set-phase data, and the second reset-phase data, and outputs a signal PWM2. The PWM2 generating circuit 219$C_2$-2 can have a similar structure to that of the PWM1 generating circuit 219$C_2$-1.

Figure 39:
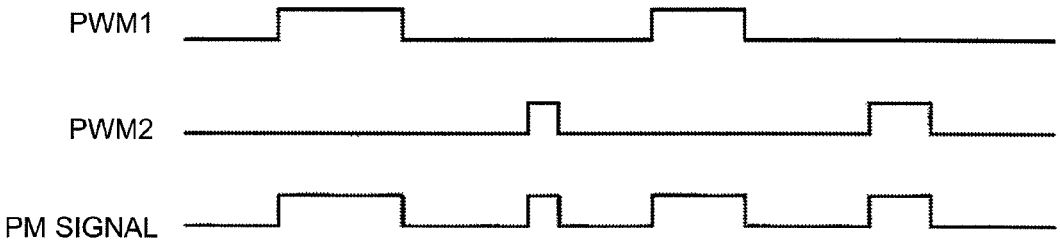
FIG. 39 is a timing chart for explaining how an OR circuit shown in FIG. 27 operates.

The OR circuit 219$C_2$-3 receives the signal PWM1 and the signal PWM2, performs an OR operation of these signals, and outputs a PM signal (see FIG. 39).

As described above, in the optical scanning device 1010 according to the embodiment, the write control circuit 219 functions as a pulse-modulation-signal generating device. The light source 14 and the write control circuit 219 function as a light-source device.

The write control circuit 219 according to the embodiment includes the high-frequency-clock generating circuit 219A, the pixel-data converting circuit 219B, and the modulation-signal generating circuit 219C. The high-frequency-clock generating circuit 219A generates a plurality of high-frequency clock signals that have different phases. The pixel-data converting circuit 219B generates transition timing data that includes data pertaining to timings of light-on and light-off based on pixel data. The light source 14 transitions from a light emitting state to a non-emitting state at the light-off and vice versa at the light-on. The modulation-signal generating circuit 219C receives a first clock signal from among the high-frequency clock signals only during a period in which the light-on and the light-off of the light source are to occur and generates a PM signal based on the transition timing data and the first clock signal. According to this configuration, power consumption can be reduced as compared with a conventional technology.

The modulation-signal generating circuit 219C selects one of the high-frequency clock signals and generates the pulse modulation signal based on the selected clock signal. Hence, a further reduction in power consumption is attained.

Accordingly, the write control circuit 219 can generate a PM signal without a substantial increase of power consumption.

Because the optical scanning device 1010 according to the embodiment includes the write control circuit 219, the light source 14 is capable of emitting pulse-modulated light without a substantial increase of power consumption. Hence, the optical scanning device 1010 can perform highly-accurate optical scanning without a substantial increase of power consumption.

Because the laser printer 1000 according to the embodiment includes the optical scanning device 1010, the laser printer 1000 is capable of forming a high-quality image without a substantial increase of power consumption.

In this embodiment, it is assumed that PCLK has a constant frequency; however, the present invention is not limited to applications that uses constant-frequency pixel clock signals.

Figure 40:
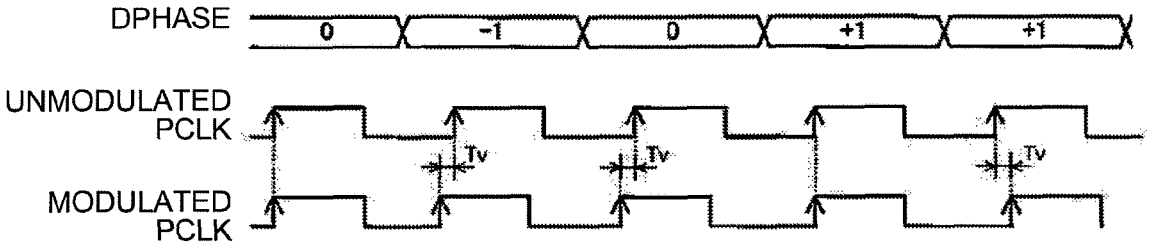
FIG. 40 is a timing chart for explaining how a pixel clock signal PCLK is modulated based on a phase signal DPHASE.
Figure 41:
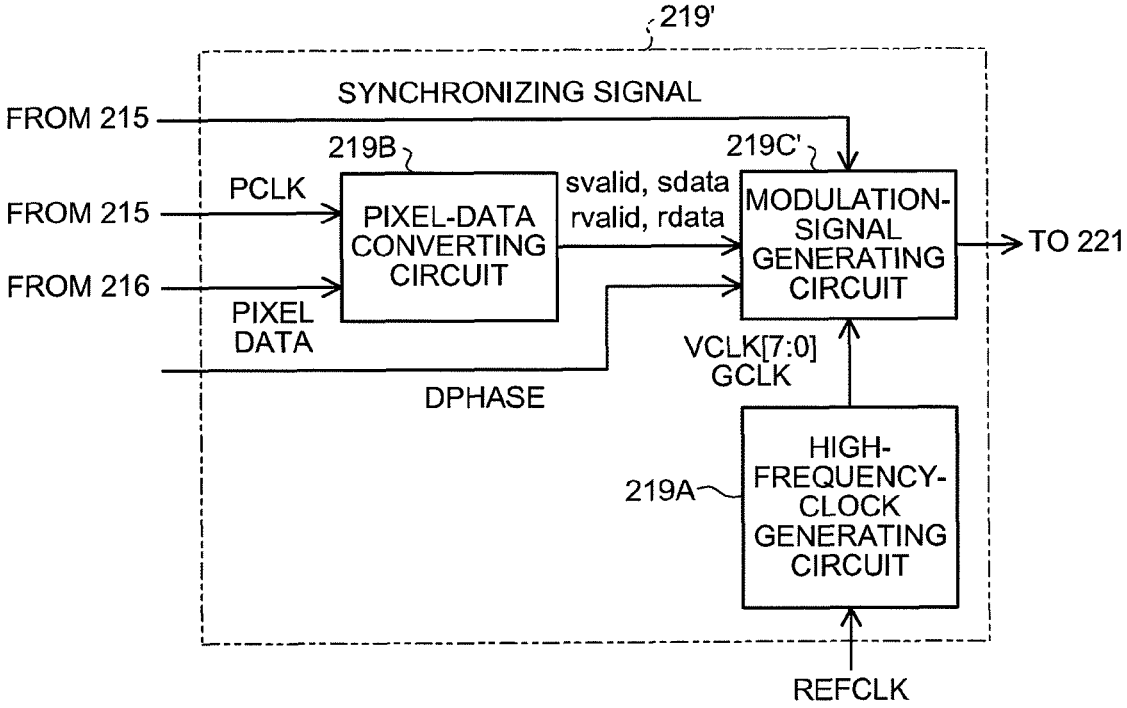
FIG. 41 is a schematic diagram of a write control circuit that can be use to modulate PCLK as shown in FIG. 40.

FIG. 40 is a timing chart of PCLK that is modulated based on a phase signal DPHASE (see Japanese Patent No. 3512397, for example). FIG. 41 is a block diagram of a write control circuit 219' that is appropriate for modulation of PCLK based on DPHASE. The write control circuit 219' includes a modulation-signal generating circuit 219C' in place of the modulation-signal generating circuit 219C. It is assumed that the phase of PCLK is advanced or delayed by one phase (Tv in this embodiment) of a high-frequency clock signal. Whether the phase of PCLK is to be unchanged, advanced, or delayed is determined by a value of DPHASE that is any one of 0, +1, and −1.

As shown in FIG. 40, on receiving DPHASE=0, the modulation-signal generating circuit 219C' does not change the phase of PCLK. On receiving DPHSE=−1, the modulation-signal generating circuit 219C' causes the phase to be advanced by Tv (i.e., clock cycle time of PCLK becomes shorter). On receiving DPHSE=+1, the modulation-signal generating circuit 219C' causes the phase to be delayed by Tv (i.e., clock cycle time of PCLK becomes longer).

Figure 42:
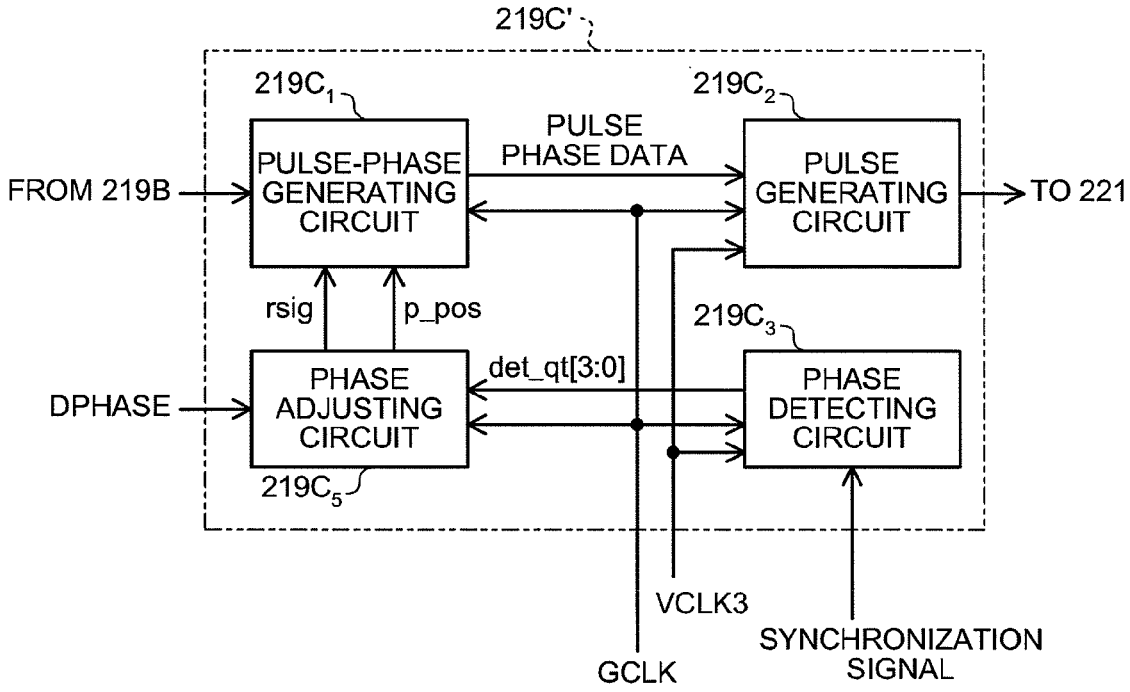
FIG. 42 is a schematic diagram of a modulation-signal generating circuit shown in FIG. 41.

As shown in FIG. 42, the modulation-signal generating circuit 219C' receives DPHASE, the transition timing data, VCLK[7:0], and GCLK, and outputs a PM signal.

The modulation-signal generating circuit 219C' includes the pulse-phase generating circuit 219$C_1$, the pulse generating circuit 219$C_2$, the phase detecting circuit 219$C_3$, and a phase adjusting circuit 219$C_5$.

Figure 43:
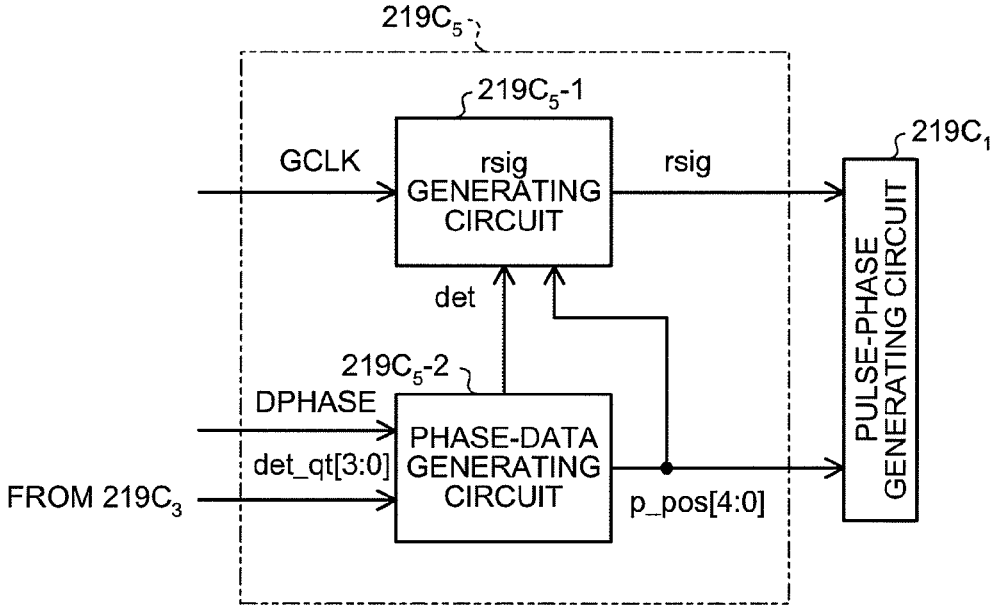
FIG. 43 is a schematic diagram of a phase adjusting circuit shown in FIG. 42.

As shown in FIG. 43, the phase adjusting circuit 219$C_5$ includes an rsig generating circuit 219$C_5$-1 and a phase-data generating circuit 219$C_5$-2.

The phase-data generating circuit 219$C_5$-2 receives det_qt [3:0] and DPHASE, and outputs p_pos[4:0] and a signal det as in the case of the phase-data generating circuit 219$C_4$-2.

The rsig generating circuit 219$C_5$-1 receives GCLK, the signal det, and p_pos[4:0], and outputs a signal rsig.

Figure 44:
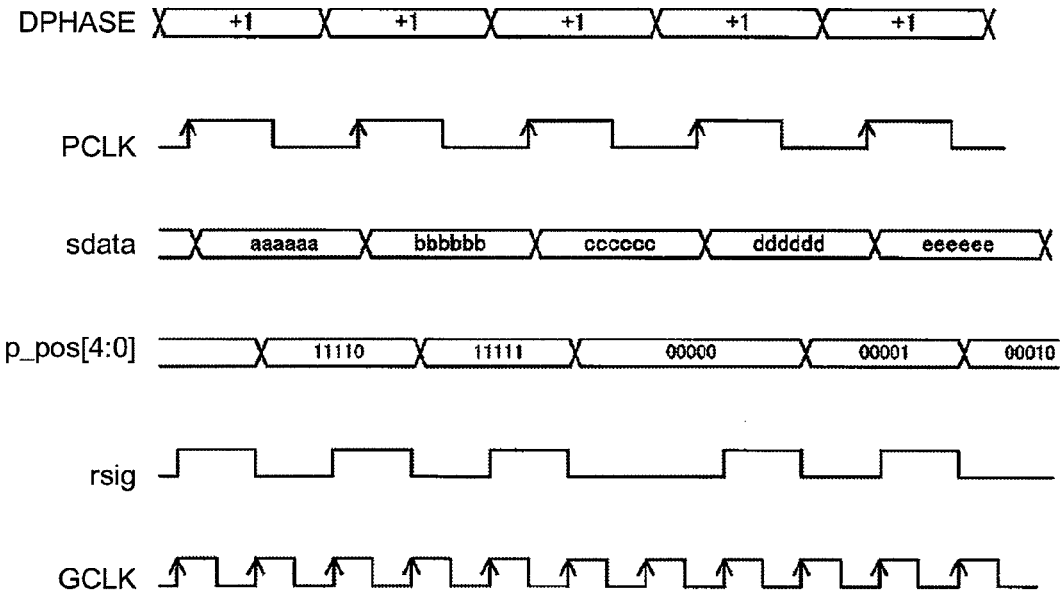
FIG. 44 is a timing chart for explaining how the phase adjusting circuit shown in FIG. 42 operates.

FIG. 44 is an example of a timing chart that explains how the phase adjusting circuit 219$C_5$ operates. When the phase adjusting circuit 219$C_5$ receives DPHASE=+1 consecutively, positions of edges of PCLK are delayed relative to GCLK stepwise. For clarity, a shift amount is depicted to be larger than an actual value relative to a clock cycle of GCLK in FIG. 44. After each cycle of the signal rsig, p_pos[4:0], which is data about the phase of PCLK, is incremented. When p_pos [4:0] changes from 11111 to 00000, that is, when an edge of PCLK is close to a position at which GCLK is to be read, the phase adjusting circuit 219$C_5$ delays the pulse of the signal rsig by one cycle. By this delay, a setup time for reading of GCLK is ensured.

In contrast, when the phase adjusting circuit 219$C_5$ receives DPHASE=−1, positions of edges of PCLK are advanced. In this case, the phase adjusting circuit 219$C_5$ generates successive pulses of the signal rsig at a change of p_pos[4:0] from 00000 to 11111 so that reading of GCLK is advanced.

As described above, timing at which GCLK is to be read can be adjusted appropriately by changing the signal rsig. By performing this adjustment, receipt and transmission of data can be performed appropriately even when PCLK is modulated.

In this embodiment, the light source 14 includes 40 light emitting units; however, the number of the light emitting units is not limited to 40.

In this embodiment, the image forming apparatus is embodied as the laser printer 1000; however, the image forming apparatus is not limited thereto. Any image forming apparatus that includes the optical scanning device 1010 can form a high-quality image without a substantial increase in cost.

For example, an image forming apparatus that emits laser beam directly onto a medium (e.g., paper) that is colored by being exposed to a laser beam can include the optical scanning device 1010.

The optical scanning device 1010 is also applicable to an image forming apparatus that uses a silver halide film as an image carrier. The image forming apparatus scans a silver halide film with light to form a latent image on the film. This latent image can be developed by a general silver halide photography developing method. The developed image can be transferred onto developing paper by a general method in silver halide photography. Examples of application of such an image forming apparatus include optical printing apparatuses and optical plotting apparatuses that plot CT scan images and the like.

Figure 45:
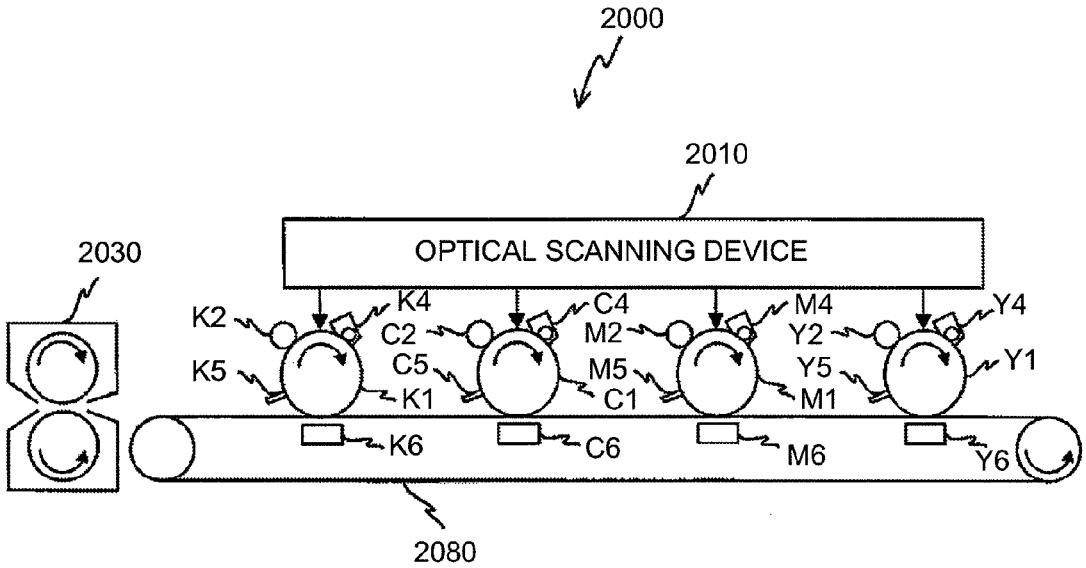
FIG. 45 is a schematic diagram of a color printer.

The image forming apparatus can be a color printer 2000 that includes a plurality of photosensitive drums as shown in FIG. 45.

The color printer 2000 is a tandem multi-color printer that includes four photosensitive drums K1, C1, M1, and Y1; however, the number of the photosensitive drums is not limited to four. The color printer 2000 forms a composite full-color image by superimposing four color (black, cyan, magenta, and yellow) images. The color printer 2000 includes, in addition to a set of units for each of the four colors, an optical scanning device 2010, a transfer belt 2080, and a fixing unit 2030. The set for black includes the photosensitive drum K1, an electrifying device K2, a developing device K4, a cleaning unit K5, and a transfer device K6. The set for cyan includes the photosensitive drum C1, an electrifying device C2, a developing device C4, a cleaning unit C5, and a transfer device C6. The set for magenta includes the photosensitive drum M1, an electrifying device M2, a developing device M4, a cleaning unit M5, and a transfer device M6. The set for yellow includes the photosensitive drum Y1, an electrifying device Y2, a developing device Y4, a cleaning unit Y5, and a transfer device Y6.

In the following explanation, an arbitrary one of the sets will be described without reference characters and numerals. The photosensitive drum rotates in a direction indicated by arrows in FIG. 45. The electrifying device, the developing device, the cleaning unit, and the transfer device are arranged in this order along the rotating direction of the photosensitive drum. The electrifying device uniformly electrifies the surface of the photosensitive drum. The optical scanning device 2010 scans the electrified surface of the photosensitive drum with light to form a latent image on the surface. The developing device develops the latent image on the surface of the photosensitive drum into a toner image. The transfer device transfers the toner image onto a recording medium. Four color toner images are successively transferred onto the recording medium. Hence, a composite four-color image is formed on the recording medium. The fixing unit 2030 fixes the four-color image on the recording medium.

The optical scanning device 2010 includes, for each of the four colors, a light source similar to the light source 14, a write control circuit similar to the write control circuit 219, a pre-deflector optical system similar to the pre-deflector optical system, and a scanning optical system similar to the scanning optical system. Hence, the optical scanning device 2010 can provide a similar advantage as that provided by the optical scanning device 1010.

A light flux emitted from an arbitrary one the light sources is received by a corresponding one of the pre-deflector optical systems and deflected by a polygon mirror. The light flux then impinges on a corresponding one of the photosensitive drums via a corresponding one of the optical scanning systems. The polygon mirror is used in a shared manner.

Accordingly, the color printer 2000 is capable of providing a similar advantage as that provided by the laser printer 1000.

The color printer 2000 can include the optical scanning device for each color or for each two colors.

According to one aspect of the present invention, a power consumption can be reduced as compared with that of a conventional technology.

Furthermore, according to another aspect of the present invention, emission of modulated light is attained without a substantial increase in power consumption.

Moreover, according to still another aspect of the present invention, scanning with light can be performed at high accuracy without a substantial increase in power consumption.

Furthermore, according to still another aspect of the present invention, a high-quality image can be formed without a substantial increase in power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A pulse-modulation-signal generating device that generates a pulse modulation signal for driving a light source to emit a pulsed light according to input image data, the pulse-modulation-signal generating device comprising:

a high-frequency clock generating circuit that generates a plurality of high-frequency clock signals having different phases; and a modulation-signal generating circuit that generates the pulse modulation signal based on transition timing data including timing data pertaining to a turn-on timing at which a state of the light source is changed from a turn-off state to a turn-on state and a turn-off timing at which the state of the light source is changed from the turn-on state to the turn-off state by inputting any one of the high-frequency clock signals only during a predetermined period including the turn-on timing and the turn-off timing.

2. A light-source device that emits a light modulated according to input image data, the light-source device comprising:

a light source that emits a light; and a pulse-modulation-signal generating device that generates a pulse modulation signal for driving the light source to emit a pulsed light according to the input image data, the pulse-modulation-signal generating device including a high-frequency clock generating circuit that generates a plurality of high-frequency clock signals having different phases, and a modulation-signal generating circuit that generates the pulse modulation signal based on transition timing data including timing data pertaining to a turn-on timing at which a state of the light source is changed from a turn-off state to a turn-on state and a turn-off timing at which the state of the light source is changed from the turn-on state to the turn-off state by inputting any one of the high-frequency clock signals only during a predetermined period including the turn-on timing and the turn-off timing.

3. The light-source device according to claim 2, wherein the light source includes a vertical-cavity surface-emitting laser.

4. The light-source device according to claim 2, wherein the light source includes a plurality of light emitting elements in an arrayed form.

5. The pulse-modulation-signal generating device according to claim 1, further comprising: a phase-data generating circuit that generates pulse phase data including position data pertaining to a rise position and a fall position of a pulse signal based on the transition timing data; and a mask-signal generating circuit that generates a mask signal for inputting the any one of the high-frequency clock signals only during the predetermined period based on the position data.

6. The pulse-modulation-signal generating device according to claim 5, wherein the mask-signal generating circuit includes: a first mask-signal generating circuit that generates a first mask signal for inputting the any one of the high-frequency clock signals only during a first period including the turn-on timing based on the position data pertaining to the rise position, and a second mask-signal generating circuit that generates a second mask signal for inputting the any one of the high-frequency clock signals only during a second period including the turn-off timing based on the position data pertaining to fall position.

* * * * *